US009751311B2

(12) United States Patent
Moriyama et al.

(10) Patent No.: US 9,751,311 B2
(45) Date of Patent: Sep. 5, 2017

(54) FLUID EJECTION DEVICE

(71) Applicant: Seiko Epson Corporation, Tokyo (JP)

(72) Inventors: Ryuji Moriyama, Matsumoto (JP); Masayuki Kumazaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/777,040

(22) PCT Filed: Mar. 11, 2014

(86) PCT No.: PCT/JP2014/001360
§ 371 (c)(1),
(2) Date: Sep. 15, 2015

(87) PCT Pub. No.: WO2014/141688
PCT Pub. Date: Sep. 18, 2014

(65) Prior Publication Data

US 2016/0031217 A1 Feb. 4, 2016

(30) Foreign Application Priority Data

| | | |
|---|---|---|
| Mar. 15, 2013 | (JP) | 2013-053233 |
| Mar. 15, 2013 | (JP) | 2013-053234 |
| Jun. 27, 2013 | (JP) | 2013-134623 |
| Jun. 28, 2013 | (JP) | 2013-136039 |
| Aug. 22, 2013 | (JP) | 2013-172038 |

(51) Int. Cl.

| | |
|---|---|
| ***B41J 2/14*** | (2006.01) |
| ***B41J 2/16*** | (2006.01) |
| ***B41J 2/165*** | (2006.01) |
| ***B41J 2/17*** | (2006.01) |
| ***B41J 29/02*** | (2006.01) |
| ***B41J 2/185*** | (2006.01) |

(52) U.S. Cl.
CPC ..... *B41J 2/165* (2013.01); *B41J 2/1433* (2013.01); *B41J 2/162* (2013.01); *B41J 2/1714* (2013.01); *B41J 2/185* (2013.01); *B41J 29/02* (2013.01); *B41J 2002/16502* (2013.01)

(58) Field of Classification Search
CPC ..... B41J 2/01; B41J 29/12; B41J 2202/22
See application file for complete search history.

(56) References Cited

U.S. PATENT DOCUMENTS

| | | | |
|---|---|---|---|
| 6,464,328 | B1 | 10/2002 | Hiramatsu et al. |
| 6,609,791 | B1 | 8/2003 | Miyamoto et al. |

(Continued)

FOREIGN PATENT DOCUMENTS

| | | | |
|---|---|---|---|
| JP | 11-005347 | A | 1/1999 |
| JP | 2000-238290 | A | 9/2000 |

(Continued)

*Primary Examiner* — Kristal Feggins
*Assistant Examiner* — Kendrick Liu
(74) *Attorney, Agent, or Firm* — Nutter McClennen & Fish LLP; John J. Penny, Jr.; Joshua I. Rudawitz

(57) ABSTRACT

A fluid ejection device has a fluid ejection head that ejects fluid droplets onto printing paper; a carriage that carries the fluid ejection head; and a static elimination member or charged member affixed to either or both the fluid ejection head and carriage. The static elimination member is configured to contactlessly eliminate the electric charge of an object, and the charged member has a polarized charge.

8 Claims, 11 Drawing Sheets

(56) References Cited

U.S. PATENT DOCUMENTS

| | | | | |
|---|---|---|---|---|
| 2007/0041756 | A1* | 2/2007 | Akaike | G03G 15/167 399/310 |
| 2007/0046727 | A1* | 3/2007 | Yanagisawa | B41J 2/14024 347/47 |
| 2008/0025767 | A1* | 1/2008 | Takagami | G03G 15/657 399/313 |
| 2010/0165063 | A1* | 7/2010 | Abramovitch | B41J 29/02 347/101 |
| 2011/0122200 | A1 | 5/2011 | Katsuki et al. | |
| 2012/0274688 | A1 | 11/2012 | Okada et al. | |
| 2013/0050346 | A1 | 2/2013 | Takeuchi et al. | |
| 2014/0064815 | A1* | 3/2014 | Takahata | G03G 15/65 399/397 |

FOREIGN PATENT DOCUMENTS

| | | | |
|---|---|---|---|
| JP | 2000-289230 | A | 10/2000 |
| JP | 2001-162778 | A | 6/2001 |
| JP | 2002-337364 | A | 11/2002 |
| JP | 2003-237110 | A | 8/2003 |
| JP | 2005-096965 | A | 4/2005 |
| JP | 2007-245466 | A | 9/2007 |
| JP | 2009-137227 | A | 6/2009 |
| JP | 2009-228804 | A | 10/2009 |
| JP | 2010-012680 | A | 1/2010 |
| JP | 2011-110788 | A | 6/2011 |
| JP | 2011-156779 | A | 8/2011 |
| JP | 2012-228804 | A | 11/2012 |

* cited by examiner

FLUID EJECTION DEVICE

Priority is claimed under 35 U.S.C. §119 to Japanese Application Nos. 2013-136039 filed on Jun. 28, 2013, 2013-134623 filed on Jun. 27, 2013, 2013-172038 filed on Aug. 22, 2013, 2013-053233 filed on Mar. 15, 2013, 2013-053234 filed on Mar. 15, 2013, respectively, and under 35 U.S.C. §365 to PCT/JP2014/001360 filed on Mar. 11, 2014.

TECHNICAL FIELD

The present invention relates to a fluid ejection device having a fluid ejection head that ejects fluid as droplets onto a medium.

BACKGROUND

Fluid ejection devices are now used in many different fields. One example of a fluid ejection device is an inkjet recording device having an inkjet head as the fluid ejection head that ejects ink onto recording paper. In an inkjet recording device, a portion of the ink droplets (fluid droplets) ejected from the inkjet head may become ink mist (minute fluid droplets) suspended inside the cabinet. Suspended ink mist may become deposited on other parts inside the cabinet, resulting in a variety of problems. As a result, various methods have been proposed as countermeasures for such ink mist in conventional fluid ejection devices.

PTL 1 discloses an inkjet recording device having a mist attraction means that electrostatically attracts ink mist. This mist attraction means connects the nozzle plate to ground to produce a potential difference between the nozzle plate and an electrode member and attract the ink mist to the electrode member. PTL 2 discloses an inkjet printer that connects the nozzle plate and a conductive brush attached to the inkjet head to ground so they have the same potential. Because the tip of the conductive brush contacts the recording paper in this configuration, the recording paper and the nozzle plate have the same potential, and there is an uncharged field between the nozzle plate and the recording paper. As a result, attraction of the charged ink mist and paper dust to the nozzle plate side can be suppressed.

PTL 3 discloses a method of applying voltage to a conductive plate disposed to the inkjet head when ejecting ink droplets from the inkjet head to actively charge the ink droplets, and applying voltage to charge a mist absorption member with the opposite polarity as the ink droplets to capture the ink mist.

PATENT LITERATURE

[PTL 1] JP-A-2009-228804
[PTL 2] JP-A-2011-156779
[PTL 3] JP-A-2012-228804

SUMMARY OF INVENTION

To suppress suspension or attraction of ink mist, the technologies disclosed in PTL 1 to PTL 3 require controlling the potential of the nozzle plate and surrounding members. However, if the ink mist is charged, the effect of electric fields and static electricity produced inside the inkjet recording device cannot be avoided, and problems can result from the suspension of ink mist that cannot be captured by the attraction means, for example, inside the printer.

In addition, the technologies taught in PTL 1 and PTL 2 require a wire and electrode for the ground connection. The technology taught in PTL 3 requires a means of controlling charging the ink droplets and a means of charging the mist absorption member. This complicates the construction and configuration of the inkjet recording device. Furthermore, the technology taught in PTL 3 requires applying a voltage to the conductive plate and mist absorption member. As a result, power is consumed to capture the ink mist.

Solution to Problem

The present invention is directed to solving at least part of the foregoing problems, and can be embodied by the configurations and examples described below.

Example 1

A fluid ejection device including: a fluid ejection head that ejects fluid droplets onto a recording medium; a carriage that carries the fluid ejection head; and a static elimination member or a charged member affixed to either or both the fluid ejection head and the carriage; the static elimination member configured to contactlessly eliminate the electrical charge of an object; and the charged member having a polarized charge.

When ink or other fluid droplets are ejected from a fluid ejection head in the related art, the trailing portion of ink drops flying toward the recording medium may separate, forming minute ink droplets that can become charged and suspended as ink mist. Because the static elimination member in the invention can remove the electric charge from the ink droplets, the fine ink droplets that conventionally become ink mist can easily drop with the ink drops onto the recording medium, and suspension of fine ink droplets is suppressed. Furthermore, even if the minute ink droplets become suspended, charging of the ink droplets can be suppressed. Construction is also simple because the static elimination member can be simply affixed and there is no need for a ground connection. Note that minute ink droplets and minute fluid droplets are referred to generically below as ink mist.

The inventors also discovered through experiments that a charged member used to capture and remove airborne dust also excels at capturing ink mist. The printer according to the invention is based on this discovery. When a charged member is used, ink mist produced when ink droplets are ejected can be captured by the charged member. As a result, ink mist soiling other parts inside the cabinet can be suppressed or prevented. Ink mist landing on and causing problems with electronic circuit boards, sensors, and other charged parts inside the cabinet can also be suppressed or prevented.

Example 2

The fluid ejection device described above, further including: a carriage moving mechanism that moves the carriage bidirectionally in a scanning direction intersecting the conveyance direction of the recording medium; the static elimination member or the charged member being affixed to either or both the side of the carriage or the fluid ejection head facing the direction of travel when the carriage moves toward one end of the path of movement, and the side of the carriage or the fluid ejection head facing the direction of travel when the carriage moves toward the other end of the path of movement.

When the carriage and fluid ejection head scan and eject ink, ink mist is pulled by negative pressure into proximity with the side facing the direction of travel when scanning.

By disposing a static elimination member to the side facing the direction of travel when scanning, static can be effectively eliminated from the ink mist, and suspension of charged ink mist can be suppressed. Alternatively, by disposing a charged member to the side facing the direction of travel when scanning, ink mist can be effectively captured and suspension of ink mist can be suppressed.

Example 3

In the fluid ejection device described above, one end of the path of carriage movement is a standby position to which the fluid ejection head retracts from above the recording medium, and the static elimination member or the charged member is affixed to the side of the carriage or the fluid ejection head facing the direction of travel when moving from the standby position to the other end of the carriage path.

When the fluid ejection device is in the standby mode, the fluid ejection head moves to the standby position, and a flushing operation is performed at the standby position to keep the nozzles in a normal operating condition. By disposing a static elimination member to the surface facing the other end of the carriage path, the suspension of ink mist produced in the flushing operation inside the cabinet can be suppressed. Alternatively, by disposing a charged member to the surface facing the other end of the carriage path, ink mist produced in the flushing operation can be captured.

Example 4

In the fluid ejection device described above, the fluid ejection head has a nozzle plate in which a nozzle is formed; and the static elimination member is affixed to the nozzle plate.

Thus comprised, charging the ink mist when separating from the ejected ink droplets can be suppressed because the charge can be removed from the ink droplets near the nozzle. Suspension of separated ink mist with a charge can therefore be suppressed, and the ink mist can be induced to drop with the ejected ink droplets to the recording medium.

Example 5

The fluid ejection device described above preferably also has: a fluid ejection head that ejects fluid droplets onto a recording medium; and a static elimination member or a charged member; and the static elimination member or the charged member is disposed to a position where one surface thereof faces the fluid ejection head.

Because the charge can be removed from ink droplets by the static elimination member, the ink mist falls easily with the ink droplets to the recording paper, and suspension of ink mist is suppressed. Furthermore, even if ink mist becomes suspended, charging the ink mist can be suppressed, and problems resulting from the ink mist being attracted to members with an electrostatic charge can be suppressed. Construction is also simple because the static elimination member can be simply affixed and there is no need for a ground connection. Alternatively, ink mist produced when ink droplets are ejected from the fluid ejection head can be captured by the charged member. Ink mist soiling the inside of the cabinet can therefore be suppressed or prevented. Ink mist landing on and causing problems with electronic circuit boards, sensors, and other charged parts inside the cabinet can also be suppressed or prevented.

Example 6

The fluid ejection device described above, further including: a head moving mechanism that moves the fluid ejection head along a defined path of movement; wherein one surface of the static elimination member or the charged member is exposed to the path of movement.

In a construction in which the fluid ejection head moves, ink mist can be easily suspended by the air current produced by movement of the fluid ejection head. Therefore, by exposing one side of the static elimination member to the carriage path, the charge can be removed from ink mist suspended in the carriage path. Alternatively, by exposing one side of the charged member to the carriage path, ink mist suspended in the carriage path can be easily captured.

Example 7

The fluid ejection device described above, including a media conveyance path passing the position where the fluid ejection head prints on the recording medium; the head moving mechanism including a carriage that carries the fluid ejection head, a carriage guide rail extending transversely intersecting the direction the recording medium is conveyed through the media conveyance path, and a carriage moving mechanism that moves the carriage along the carriage guide rail; and the static elimination member or the charged member being disposed facing the carriage guide rail.

Static is easily produced by friction from the carriage sliding on the carriage guide rail. The carriage guide rail is therefore easily charged, and the charged ink mist is attracted from the fluid ejection head to around the carriage guide rail. By disposing a static elimination member facing the fluid ejection head and carriage guide rail, static can be eliminated from the ink mist attracted to the carriage guide rail. Furthermore, by disposing a charged member facing the fluid ejection head and carriage guide rail, ink mist can be easily captured. The effectiveness of capturing ink mist can be further improved by disposing the charged member as close as possible to the carriage guide rail.

Example 8

The fluid ejection device described above, further including: a frame extending along the path of movement; wherein the static elimination member or the charged member is affixed to the frame.

Thus comprised, one side of the static elimination member or charged member can be exposed to the carriage path through a wide area along the carriage path.

Example 9

The fluid ejection device described above, including a pair of side frames disposed to the front and back in the direction of movement of the fluid ejection head with the path of movement therebetween, the static elimination member or the charged member disposed to at least one of the pair of side frames.

Thus comprised, the static elimination member can remove the charge from charged ink mist moving forward in the direction of travel by the positive pressure accompanying movement of the fluid ejection head, and charged ink mist dispersed to the back opposite the direction of travel by the negative pressure accompanying movement of the fluid ejection head. Alternatively, charged ink mist moving forward in the direction of travel by the positive pressure accompanying movement of the fluid ejection head, and charged ink mist dispersed to the back opposite the direction of travel by the negative pressure accompanying movement of the fluid ejection head, can be captured by the charged member.

Example 10

The fluid ejection device described above, further including: a cabinet that houses the fluid ejection head and the head moving mechanism, and has the path of movement formed thereinside; the cabinet having an access cover that opens and closes at least part of the path of movement; and the static elimination member or the charged member being affixed to an inside surface of the access cover.

This access cover is provided for maintenance inside the cabinet, and is disposed adjacent to the carriage path. Therefore, if the static elimination member or charged member is disposed to the access cover, the static elimination member can remove the charge from charged ink mist suspended by the movement of air accompanying movement of the fluid ejection head. Alternatively, the charged member can capture ink mist suspended by the movement of air accompanying movement of the fluid ejection head.

Example 11

The fluid ejection device described above, including a media conveyance path passing the printing position of the fluid ejection head; the head moving mechanism moving the fluid ejection head bidirectionally between a first outside position removed to one side of the width of the media conveyance path, and a second outside position removed to the other side; a head maintenance mechanism that maintains the fluid ejection head disposed to the first outside position; a bottom frame disposed facing the nozzle face of the fluid ejection head at the second outside position; and the static elimination member or the charged member disposed to the bottom frame.

Thus comprised, when the fluid ejection head moves across the width of the media conveyance path to print to the recording medium conveyed through the media conveyance path, the second outside position is a space to which the fluid ejection head retreats when printing near the widthwise edge of the recording medium, and this space easily becomes a channel for the movement of air. More specifically, charged ink mist moves through the space created at the second outside position to other places inside the cabinet. Therefore, by disposing the static elimination member to the bottom frame in this space, movement of charged ink mist to other parts inside the cabinet can be suppressed or prevented. Alternatively, by disposing the charged member to the bottom frame in this space, movement of ink mist to other parts inside the cabinet can be suppressed or prevented.

Example 12

A fluid ejection device including: a fluid ejection head having a nozzle plate in which a nozzle that ejects fluid droplets onto a recording medium is formed; a carriage that carries the fluid ejection head; a carriage moving mechanism that moves the carriage along a carriage path in a direction intersecting the media conveyance path through which the recording medium is conveyed; a static elimination member that can contactlessly eliminate the electrical charge of an object; and a charged member having a polarized charge; the static elimination member disposed to a position closer to the nozzle than the position where the charged member is disposed.

When fluid droplets are ejected from a fluid ejection head, the trailing portion of fluid drops flying toward the recording medium may separate, forming minute fluid droplets, and these fine fluid droplets can become charged and suspended as ink mist. The fluid ejection device in this configuration has a static elimination member that can contactlessly remove the electric charge from objects disposed near the nozzles from which the fluid droplets are ejected. The static elimination member can therefore remove the charge from the fluid droplets. As a result, the ink mist can easily drop with the fluid drops onto the recording medium, and suspension of ink mist is suppressed The inventors also discovered through experiments that a charged member used to capture and remove airborne dust also excels at capturing ink mist. The fluid ejection device according to the invention is based on this discovery. Thus comprised, ink mist that becomes suspended can be captured at a desired location by a charged member. As a result, suspension of ink mist can be reduced, and ink mist landing on and causing problems with other parts can be suppressed, by a simple configuration.

Example 13

The fluid ejection device described above, wherein: the position where the charged member is disposed is a position unaffected by the static elimination effect of the static elimination member.

Thus comprised, the static elimination member can first remove the charge from fluid droplets, and suspended ink mist can be reduced. Charged ink mist that could not be completely destaticized can also be captured by the charged member. Suspension of ink mist can therefore be effectively suppressed, and ink mist landing on and causing problems with other parts inside the cabinet can be suppressed.

Example 14

The fluid ejection device described above, wherein: the nozzle plate includes a nozzle face where the nozzle is formed, and a plurality of plate surfaces that extend at a specific angle from the nozzle face; and the static elimination member is disposed to the nozzle face.

Thus comprised, fluid droplets can be destaticized at the nozzle face where the nozzles from which the fluid droplets are ejected are disposed. Suspension of separated ink mist with a charge can therefore be effectively suppressed, and the ink mist can be induced to drop with the ejected fluid droplets to the recording medium.

Example 15

The fluid ejection device described above, wherein: the charged member is disposed to at least one of the plural plate surfaces.

Thus comprised, ink mist that could not be completely destaticized at the nozzle face where the nozzles from which the fluid droplets are ejected are disposed can be captured by the charged member disposed to the nearest plate surface.

Example 16

The fluid ejection device described above, wherein the carriage has a plurality of carriage sides at a specific angle to the nozzle face of the fluid ejection head; and the charged member is disposed to at least one of the plural carriage sides.

Thus comprised, ink mist that could not be completely destaticized at the nozzle plate where the nozzles from which the fluid droplets are ejected are disposed can be captured by the charged member disposed to the side of the carriage that carries the fluid ejection head.

Example 17

The fluid ejection device described above, further including: a pair of frames extending in the direction of carriage movement with the carriage moving mechanism therebetween; and a pair of side frames disposed to the front and back in the direction of carriage movement with the path of carriage movement therebetween; wherein at least one charged member is disposed to a surface of the pair of frames and the pair of side frames facing the movement area of the carriage.

In a construction in which the fluid ejection head moves, charged ink mist can be easily suspended by the air current produced by movement of the fluid ejection head and carriage. Thus comprised, ink mist that could not be completely destaticized at the nozzle plate where the nozzles from which the fluid droplets are ejected are disposed can be captured by the charged members disposed to the frame and the side frame defining the movement area of the fluid ejection head.

Example 18

The fluid ejection device described above, further including: a cabinet containing the fluid ejection head, the carriage, and the carriage moving mechanism, and having the carriage path formed thereinside; the cabinet having an access cover that opens and closes at least part of the carriage path; and the charged member being disposed to an inside surface of the access cover.

This access cover is provided for maintenance inside the cabinet, and is disposed adjacent to the carriage path. Therefore, if the charged member is disposed to the access cover, ink mist that could not be completely destaticized at the nozzle plate where the nozzles from which the fluid droplets are ejected are disposed and is dispersed by the air flow produced by movement of the fluid ejection head and carriage can be captured by the charged member disposed to the access cover.

Example 19

The fluid ejection device described above, wherein: the nozzle plate includes a nozzle face in which the nozzle is formed, and a plurality of plate surfaces that extend at a specific angle from the nozzle face; and the static elimination member is disposed to at least one of the plural plate surfaces.

Thus comprised, fluid droplets can be destaticized near the nozzle plate where the nozzles from which the fluid droplets are ejected are disposed. Suspension of separated ink mist with a charge can therefore be suppressed, and the ink mist can be induced to drop with the ejected fluid droplets to the recording medium.

Example 20

The fluid ejection device described above, wherein: the carriage has a plurality of carriage sides at a specific angle to the nozzle face of the fluid ejection head; and the charged member is disposed to at least one of the plural carriage sides of the carriage.

Thus comprised, ink mist that could not be completely destaticized at the surface of the nozzle plate can be captured by the charged member disposed to the carriage that carries the fluid ejection head.

Example 21

The fluid ejection device described above, further including a pair of frames extending in the direction of carriage movement with the carriage moving mechanism therebetween; and a pair of side frames disposed to the front and back in the direction of carriage movement with the path of carriage movement therebetween; wherein at least one charged member is disposed to a surface of the pair of frames and the pair of side frames facing the movement area of the carriage.

In a construction in which the fluid ejection head moves, charged ink mist can be easily suspended by the air current produced by movement of the fluid ejection head and carriage. In this configuration, suspended ink mist that could not be completely destaticized at the surface of the nozzle plate can be captured by the charged member disposed to the frame part that defines the path of the fluid ejection head.

Example 22

The fluid ejection device described above, including a cabinet that houses the fluid ejection head, carriage, and the carriage moving mechanism, and has the path of carriage movement formed thereinside; the cabinet having an access cover that opens and closes at least part of the carriage path; and the charged member being disposed to an inside surface of the access cover.

This access cover is provided for maintenance inside the cabinet, and is disposed adjacent to the carriage path. Therefore, if the charged member is disposed to the access cover, ink mist that cannot be completely destaticized at the surface of the nozzle plate and is suspended by the movement of air accompanying movement of the fluid ejection head and carriage can be captured by the charged member affixed to the access cover.

Example 23

The fluid ejection device described above, wherein: the carriage has a plurality of carriage sides at a specific angle to the nozzle face of the fluid ejection head; and the static elimination member is disposed to at least one of the plural carriage sides of the carriage.

Thus comprised, fluid droplets can be destaticized at a part of the carriage that carries the fluid ejection head from which the fluid droplets are ejected. Suspension of separated ink mist with a charge can therefore be effectively suppressed, and the ink mist can be induced to drop with the ejected fluid droplets to the recording medium.

Example 24

The fluid ejection device described above, wherein the carriage has a flat surface at a position facing the nozzle face of the fluid ejection head, and the charged member is disposed to said flat surface.

Thus comprised, ink mist that could not be completely destaticized at the side of the carriage can be captured by the charged member disposed to the top of the carriage carrying the fluid ejection head.

Example 25

The fluid ejection device described above, further including: a pair of frames extending in the direction of carriage movement with the carriage moving mechanism therebetween; and a pair of side frames disposed to the front and back in the direction of carriage movement with the carriage path therebetween; wherein at least one charged member is disposed to a surface of the pair of frames and the pair of side frames facing the movement area of the carriage.

In a construction in which the fluid ejection head moves, charged ink mist can be easily suspended by the air current produced by movement of the fluid ejection head and carriage. Thus comprised, ink mist that could not be completely destaticized at the surface of the carriage can be captured by the charged members disposed to the frame defining the movement area of the fluid ejection head.

Example 26

The fluid ejection device described above, further including: a cabinet containing the fluid ejection head, the carriage, and the carriage moving mechanism, and having the carriage path formed thereinside; the cabinet having an access cover that opens and closes at least part of the carriage path; and the charged member being disposed to an inside surface of the access cover.

This access cover is provided for maintenance inside the cabinet, and is disposed adjacent to the carriage path. Therefore, if the charged member is disposed to the access cover, ink mist that could not be completely destaticized at the carriage surface and is dispersed by the air flow produced by movement of the fluid ejection head and carriage can be captured by the charged member disposed to the access cover.

Example 27

A fluid ejection device including: a pair of side frames disposed to the front and back in the direction of carriage movement with the carriage path therebetween; one of the pair of side frames being a standby position to which the fluid ejection head retracts from above the recording medium; the static elimination member disposed to one of the pair of side frames; and the charged member disposed to the other of the pair of side frames.

When the fluid ejection device is in the standby mode, the fluid ejection head moves to the standby position, and a flushing operation is performed at the standby position to keep the nozzles in a normal operating condition. By disposing a static elimination member to the side frame where the fluid ejection head waits, this aspect of the invention can suppress the suspension of ink mist produced in the flushing operation inside the cabinet. Ink mist that is not completely destaticized can also be captured by the charged member disposed to the other side frame.

Example 28

The fluid ejection device described above, further including: a pair of frames extending in the direction of carriage movement with the carriage moving mechanism therebetween; the static elimination member disposed to the pair of frames on the frame that is closer to the path of the fluid ejection head; and the charged member disposed to the pair of frames on the frame that is farther from the path of the fluid ejection head.

Thus comprised, ink mist produced in conjunction with movement of the fluid ejection head is destaticized by the static elimination member disposed to the frame member closest to the area of fluid ejection head movement, and suspended ink mist that is not completely destaticized is captured by the charged member disposed to the other frame member.

Example 29

The fluid ejection device described above, wherein the static elimination member is a static elimination strip of a fibrous material containing short conductive fibers formed in a sheet.

Thus comprised, the static elimination strip woven with short fibers of a conductive material can produce innumerable corona arcs with a low charge, and function as a contactless static elimination member with high static elimination performance.

Example 30

The fluid ejection device described above, wherein the charged member is removably disposed.

Thus comprised, a charged member soiled by capturing ink mist can be easily replaced with a new charged member.

Example 31

The fluid ejection device described above, wherein the charged member is a charged filter made from a porous electret.

Thus comprised, a charged filter made from a porous electret can be used as the charged member. The charged filter is made from an electret with a porous structure, such as a non-woven cloth of polypropylene or other thermoplastic resin. An electret is a dielectric with persistent electric polarization. More specifically, by using a charged filter as the charged member, ink mist can be captured by a simple construction without consuming electricity.

Example 32

The fluid ejection device described above, wherein: the fluid forming the fluid droplets includes ink; the fluid ejection head includes an inkjet head; and the fluid ejection device includes an inkjet recording device and a printing device.

DETAILED DESCRIPTION

An inkjet printer is described below as an example of a fluid ejection device according to the invention with reference to the accompanying figures. An inkjet printer ejects ink (fluid) as ink droplets (fluid droplets) from an inkjet head as the fluid ejection head, and prints information on printing paper as the recording medium. Note that for convenience of description and illustration, the vertical and horizontal scale of members and parts shown in the figures referenced below may differ from the actual scale.

General Configuration of the Printer

Figure 1:
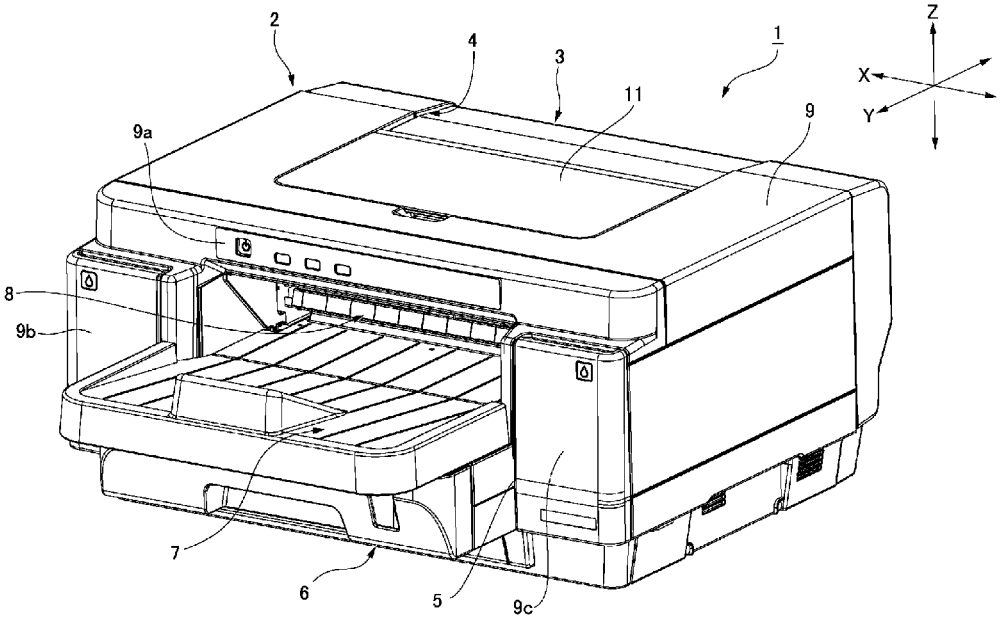
FIG. 1 is an external oblique view of a printer according to the invention from the front.

The general configuration of an inkjet printer (referred to below as simply a printer) according to the invention is described first below with reference to FIG. 1. FIG. 1 is an external oblique view from the front of the printer according to the invention. Note, further, that the X-axis shown in FIG. 1 denotes the direction across the width of the printing paper, the Y-axis denotes the direction in which the printing paper is discharged, and the Z-axis is the direction perpendicular to the transverse axis X and the longitudinal axis Y.

As shown in FIG. 1, the printer 1 has a main printing unit 2 and a reversing unit 3. The main printing unit 2 has a basically rectangular box-like shape that is long on the transverse axis X. A recess 4 is formed in the middle of the back of the main printing unit 2, and the reversing unit 3 is installed in this recess 4. The reversing unit 3 is a unit for reversing the front and back sides of the printing paper (see FIG. 2), which is a cut-sheet recording medium, and then returning the reversed paper into the main printing unit 2.

A paper cassette loading unit 5 is installed to the main printing unit 2. The paper cassette loading unit 5 opens to the front of the printer (the front on the longitudinal axis Y) at a position toward the bottom on the vertical axis Z in the front of the main printing unit 2. A paper cassette 6 can be loaded from the front into the paper cassette loading unit 5. A paper discharge tray 7 is attached at the top of the paper cassette loading unit 5. The front end of the paper discharge tray 7 extends from the main printing unit 2 to the front of the printer. A rectangular paper exit 8 extending toward the back of the printer (the back on the longitudinal axis Y) is formed above the paper discharge tray 7.

The outside case 9, which is the cabinet of the main printing unit 2, has an operating panel 9*a* at the front above the paper exit 8. The operating panel 9 includes a power switch and a status indicators. Rectangular access doors 9*a*, 9*b* are attached to the outside case 9 at the front of the printer on opposite sides of the paper discharge tray 7 and paper exit 8 on the transverse axis X. When the access doors 9*a*, 9*b* are opened, the ink cartridge loading unit 10 (see FIG. 4) opens and the ink cartridges (not shown in the figure) can be replaced. The top of the outside case 9 is substantially flat, and an access cover 11 for maintenance is attached in the middle.

Internal Configuration of the Printer

Figure 2:
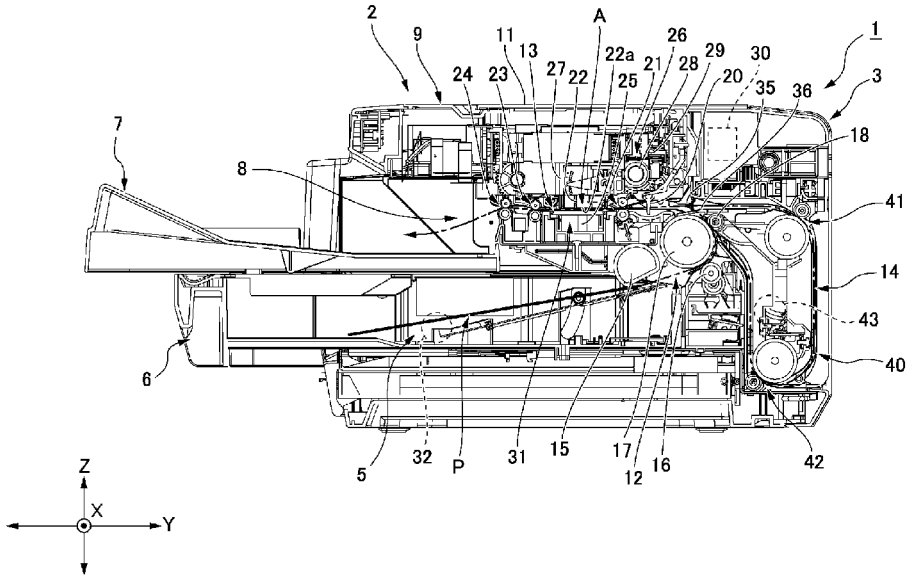
FIG. 2 is a vertical section view showing the internal configuration of the printer.

The internal configuration of the printer is described next with reference to FIG. 2. FIG. 2 is a vertical section view showing the internal configuration of the printer. The transverse axis X, longitudinal axis Y, and vertical axis Z in FIG. 2 denote the same axes as the transverse axis X, longitudinal axis Y, and vertical axis Z in FIG. 1.

As shown in FIG. 2, a printing paper supply path 12, main conveyance path 13, and reversing conveyance path 14 are formed inside the printer 1. The printing paper supply path 12 and main conveyance path 13 are formed inside the outside case 9 of the main printing unit 2, and the reversing conveyance path 14 is formed inside the reversing unit 3.

The printing paper supply path 12 is a conveyance path that conveys printing paper P of a specific size stored in a stack in the paper cassette 6 to the main conveyance path 13. The printing paper supply path 12 and the paper cassette 6 are located below the main conveyance path 13. The printing paper supply path 12 extends diagonally up to the back from the back end of the paper cassette loading unit 5 on the longitudinal axis Y, curves toward the front, and connects to the main conveyance path 13. Printing paper P stored in the paper cassette 6 is fed by a paper feed roller 15 to the printing paper supply path 12. The supplied paper is fed one sheet at a time through the nipping part of a conveyance roller 17 and a retard roller 16, and through the nipping part of the conveyance roller 17 and a follower roller 18 to the main conveyance path 13.

The main conveyance path 13 is the conveyance path extending substantially horizontally along the longitudinal axis Y to the paper exit 8. Disposed along the main conveyance path 13 from the back of the printer to the front of the printer are a paper end sensor 20, a paper feed roller pair 21, a printhead 22, a first discharge roller pair 23, and a second discharge roller pair 24.

The paper end sensor 20 and printhead 22 are located above the main conveyance path 13. A platen 25 is disposed to the main conveyance path 13 at the printing position A opposite the printhead 22 with a specific gap to the printhead 22. The printhead 22 is an inkjet head, a type of fluid ejection head, and is moved bidirectionally on the transverse axis X of the main conveyance path 13 by a head moving mechanism 26. The head moving mechanism 26 includes a carriage 27 that carries the printhead 22, a carriage guide rail 28 that extends on the transverse axis X, a carriage moving mechanism 29 that moves the carriage 27 along the carriage guide rail 28, and a carriage motor 30, and these parts are disposed above the main conveyance path 13.

The descending path 17 and bottom path 18, paper feed roller pair 21, first discharge roller pair 23, and second discharge roller pair 24 embody a main conveyance mechanism 31 that conveys the printing paper P through the main conveyance path 13. The main conveyance mechanism 31 is driven by a conveyance motor 32 disposed beside the paper cassette 6 on the transverse axis X. The main conveyance mechanism 31 conveys the printing paper P to the printer front when the conveyance motor 32 drives forward, and conveys the printing paper P toward the printer back when the conveyance motor 32 drives in reverse. Printing by the printhead 22 occurs when the printing paper P passes the printing position A while travelling to the printer front.

The reversing conveyance path 14 is disposed below the main conveyance path 13 on the vertical axis Z and is a conveyance path that generally forms a loop on the vertical axis Z. A first reversing conveyance roller pair 41 and a second reversing conveyance roller pair 42 are disposed to the reversing conveyance path 14 as a reversing conveyance mechanism 40 that conveys the printing paper P through the reversing conveyance path 14. The reversing conveyance mechanism 40 is driven by a reversing conveyance motor 43 disposed inside the reversing conveyance path 14. The reversing conveyance mechanism 40 conveys the printing paper P fed from the main conveyance path 13 clockwise as seen in FIG. 2 through the reversing conveyance path 14. The printing paper P is reversed front and back by passing through the reversing conveyance path 14, and is then returned to the main conveyance path 13.

For duplex printing by the printer 1, the printing paper P stored in the paper cassette 6 is first delivered by the paper feed roller 15 to the printing paper supply path 12. The conveyance motor 32 is driven forward, and the printing paper P delivered to the printing paper supply path 12 is conveyed by the retard roller 16 and conveyance roller 17 to the main conveyance path 13. The printing paper P delivered to the main conveyance path 13 is conveyed toward the front of the printer by the main conveyance mechanism 31, and passes the printing position A. The printing operation of ejecting ink droplets as the fluid droplets while moving the printhead 22 on the transverse axis X is executed at the printing position A synchronously to the conveyance operation of the printing paper P by the main conveyance mechanism 31. As a result, the front side of the printing paper P is printed.

When printing the front side of the printing paper P is completed, the conveyance motor 32 is driven in reverse. The reversing conveyance motor 43 is also driven. By thus driving the conveyance motor 32, the printing paper P is conveyed by the main conveyance mechanism 31 toward the back of the printer, and is fed from the main conveyance path 13 to the reversing conveyance path 14. The printing paper P fed into the reversing conveyance path 14 is then conveyed by the reversing conveyance mechanism 40 through the reversing conveyance path 14, and is returned to the main conveyance path 13 with the front and back sides reversed.

The printing paper P returned to the main conveyance path 13 is then again conveyed to the printer front by the main conveyance mechanism 31, and passes the printing position A of the printhead 22. The printing operation of ejecting ink droplets while moving the printhead 22 on the transverse axis X is executed at the printing position A synchronously to the conveyance operation of the printing paper P by the main conveyance mechanism 31. As a result, the back side of the printing paper P is printed. When printing the back side of the printing paper P is completed, the main conveyance mechanism 31 continues conveying the printing paper P to the printer front and discharges the printing paper P from the paper exit 8.

Path of the Head Moving Mechanism and Printhead

Figure 3:
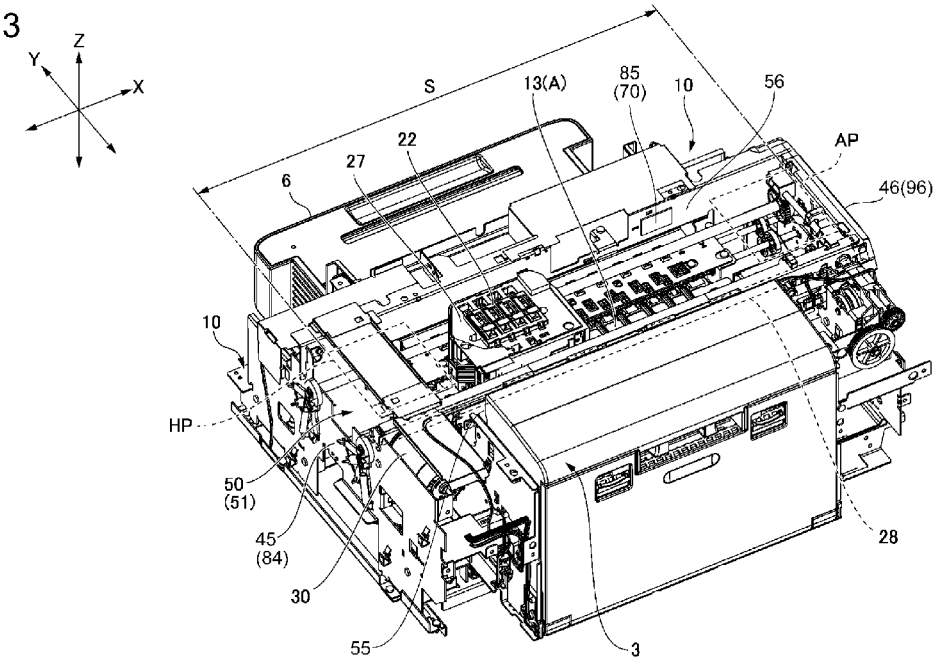
FIG. 3 is an oblique view from the back of the printer showing the printer with the outside case removed.
Figure 4:
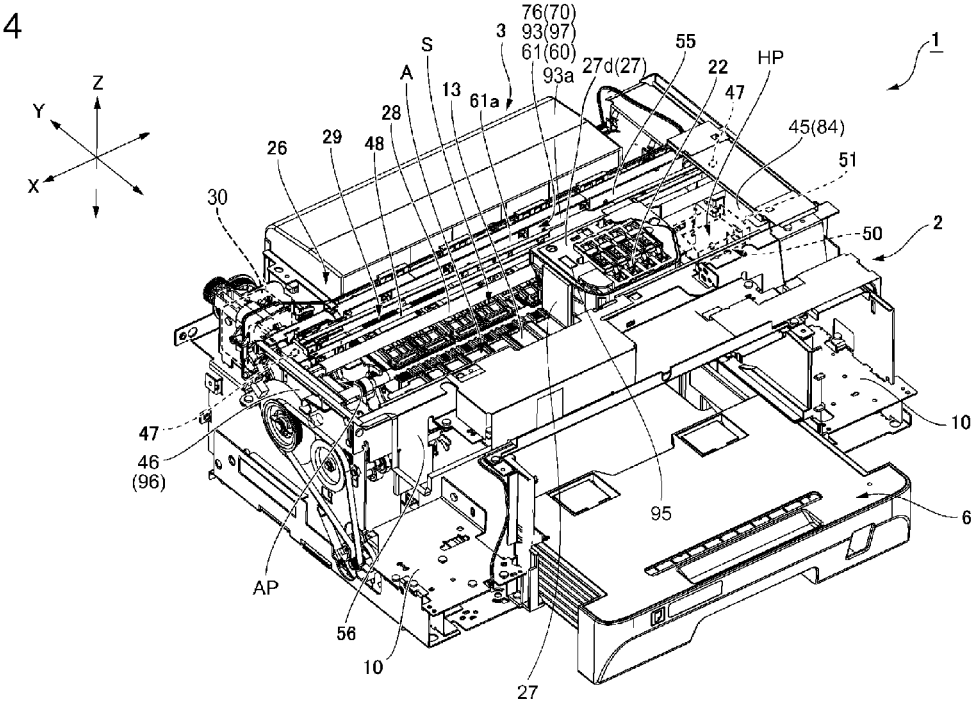
FIG. 4 is an oblique view from the front of the printer showing the printer with the outside case removed.
Figure 5:
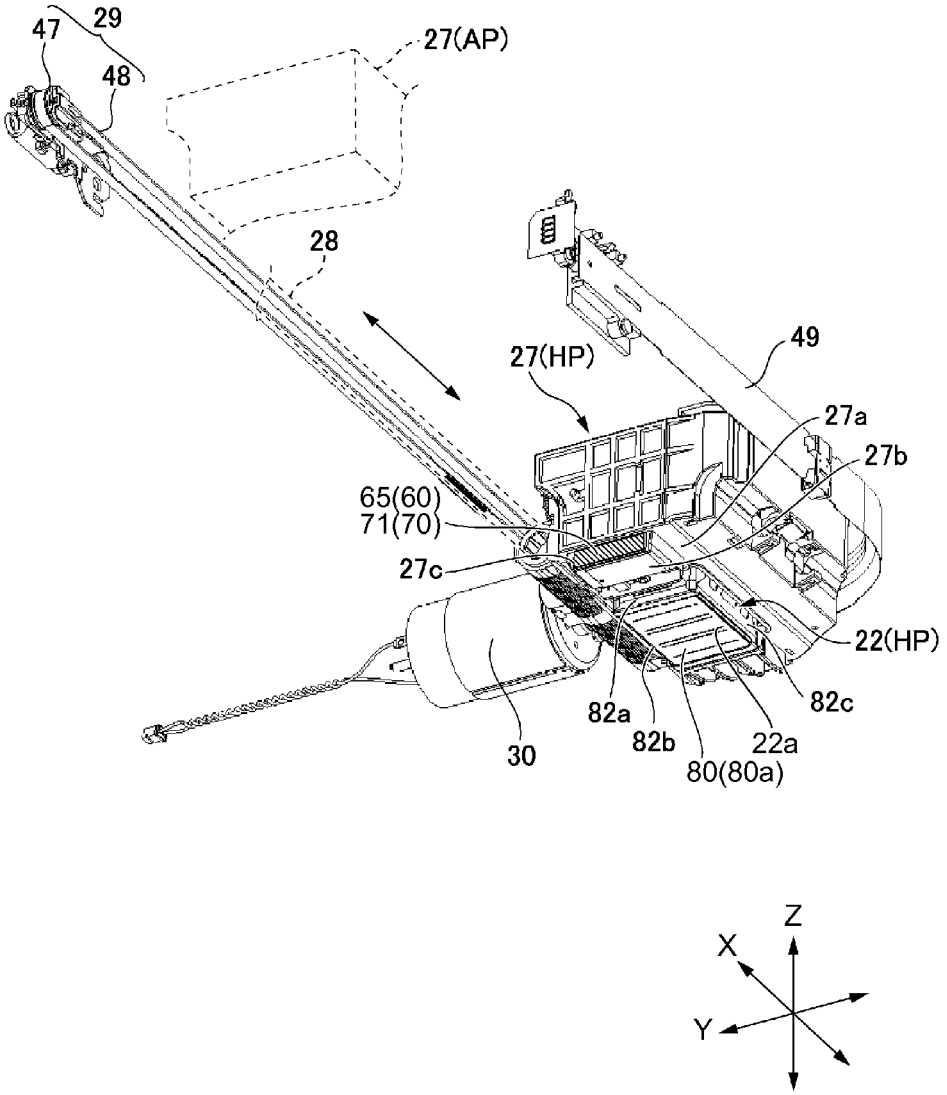
FIG. 5 is an oblique view of the printhead, head moving mechanism, and ink path of the printer in FIG. 1 from diagonally below the front of the printer.

The path of head moving mechanism and printhead movement is described next with reference to FIG. 2 to FIG. 5. FIG. 3 is an oblique view of the printer from the back of the printer with the outside case removed, and FIG. 4 is an oblique view of the printer from the front of the printer with the outside case removed. FIG. 5 is an oblique view of the printhead, head moving mechanism, and ink path in the printer shown in FIG. 1 from diagonally below the front of the printer. The transverse axis X, longitudinal axis Y, and vertical axis Z shown in FIG. 3 to FIG. 5 are identical to the transverse axis X, longitudinal axis Y, and vertical axis Z shown in FIG. 1.

As shown in FIG. 2, the carriage 27 supports the printhead 22 on the side of the carriage guide rail 28 toward the printer front. The carriage moving mechanism 29 and carriage motor 30 are disposed on the back side of the carriage guide rail 28.

As shown in FIG. 3 and FIG. 4, one end of the carriage guide rail 28 is supported by a first side frame 45 extending on the longitudinal axis Y and the vertical axis Z at the end on one side of the transverse axis X. The first side frame 45 is separated by a specific gap from the main conveyance path 13. The other end of the carriage guide rail 28 is supported by a second side frame 46 that is parallel to the first side frame 45 at the end on the other side of the transverse axis X. The second side frame 46 is also separated by a specific gap from the main conveyance path 13.

The carriage moving mechanism 29 includes a pair of timing pulleys 47, which are respectively disposed near the first side frame 45 and near the second side frame 46, and a timing belt 48 that is mounted on the pair of timing pulleys 47. The timing belt 48 extends along the carriage guide rail 28. The carriage 27 is connected to the timing belt 48, and drive power from the carriage motor 30 is transferred to one of the pulleys 47. The timing belt 48 therefore turns by driving the carriage motor 30, and the carriage 27 therefore moves along the carriage guide rail 28.

As shown in FIG. 3 and FIG. 4, the home position HP (standby position) of the printhead 22 and carriage 27 is between the main conveyance path 13 and the first side frame 45. The maintenance mechanism 50 of the printhead 22 is located at the home position HP. The maintenance mechanism 50 has a head cap 51 disposed opposite the nozzle face 22*a* of the nozzle plate 80 of the printhead 22 (see FIG. 5) set to the home position HP, and a cap lift mechanism (not shown in the figure) that moves the head cap 51 in the direction to and away from the nozzle face 22*a*.

When the printer 1 enters the standby mode, the printhead 22 is moved to the home position HP by the head moving mechanism 26, and the nozzle face 22*a* is covered by the head cap 51. The printhead 22 is also moved to the home position HP by the head moving mechanism 26 at a predetermined time interval, and a flushing operation that ejects ink droplets into the head cap 51 is performed. This flushing operation is a maintenance operation that resolves clogging of the nozzles 36 (see FIG. 5) due to increased ink viscosity, for example.

The away position AP of the printhead 22 and carriage 27 is between the main conveyance path 13 and the second side frame 46. The away position AP is a space for moving the printhead 22 to the outside of the main conveyance path 13 when printing at the edge of the width of the printing paper P when the printhead 22 moves on the transverse axis X and prints on the printing paper conveyed through the main conveyance path 13.

The printhead 22 and carriage 27 move bidirectionally in a line along the carriage guide rail 28 between the home position HP and the away position AP. The space of which the home position HP is one end and the away position AP is the other end is therefore the path S (carriage path) of printhead 22 and carriage 27 movement. A flexible ink path 49 (see FIG. 5) is connected to the printhead 22, and the printhead 22 is connected to the ink cartridge (not shown in the figure) through the ink path 49. When the printhead 22 moves between the home position HP and away position AP, the ink path 49 deforms following the movement of the printhead 22.

Note that the printer 1 according to this embodiment has a rear frame 55 connecting the tops of the first side frame 45 and second side frame 46 at a position behind the carriage path S, that is, at a position closer to the back of the printer than the timing belt 48. A front frame 56 connects the tops of the first side frame 45 and second side frame 46 at a position in front of the carriage path S, that is, at a position closer to the front of the printer than the printhead 22. The rear frame 55 and front frame 56 extend parallel to each other on the transverse axis X. The front frame 56 supports part of the flexible ink path 49 that supplies ink to the printhead 22.

Embodiment 1

A printer as an example of a fluid ejection device according to the first embodiment of the invention is described next with reference to FIG. 5. The printer according to the first embodiment of the invention is an example applying a static elimination member to manage ink mist.

Location of Static Elimination Member

In printers having an inkjet head as the printhead 22, a portion of the ink droplets ejected from the printhead 22 may separate from the body of the ink droplets flying toward the printing paper P during the printing operation and flushing operation, creating ink mist before reaching the printing paper P or the head cap 51 and becoming suspended inside the outside case 9. These suspended ink droplets (ink mist) may be deposited on and soil other parts inside the outside case 9. Furthermore, because the ink mist is charged by the charge of the nozzle face 22*a* of the printhead 22 or the charge of the platen 25, the ink mist may be deposited on and cause problems with charged components such as the control board and sensors, including the paper end sensor 20. To address this problem, the printer 1 according to this embodiment has a static elimination strip 70 (first static elimination strip 71) attached to part of the side of the carriage 27 to contactlessly eliminate the charge of the ink droplets.

Note that static elimination strip 70 is used below to refer generally to the static elimination strips as static elimination members, and first static elimination strip 71, second static elimination strip 72, third static elimination strip 73, and so forth are used when referring to individual static elimination strips.

FIG. 5 shows the printhead 22 and carriage 27 at the home position HP. As shown in FIG. 5, an opening is formed in the middle of the bottom 27*a* of the carriage 27, and the nozzle plate 80 disposed to the bottom end of the printhead 22 protrudes down on the vertical axis Z from this opening. Ink nozzles are formed in the bottom 80*a* of the nozzle plate 80, and the bottom 80*a* embodies the nozzle face 22*a* of the printhead 22.

A rectangular protrusion 27*b* that protrudes down is formed to the bottom 27*a* of the carriage 27 at a position near the away position AP side of the nozzle plate 80. The first static elimination strip 71 is affixed to the side 27*c* of the protrusion 27*b* facing the away position AP. This side 27*c* is the side facing the direction of travel when the printhead 22 and carriage 27 move to the away position AP side (to the other end of the carriage path S). The distance the protrusion 27*b* projects from the bottom 27*a* is less than the nozzle plate 80, and the side 27*c* is above the nozzle face 22*a* on the vertical axis Z.

The static elimination strip 70 is a non-woven cloth of a fibrous material including short conductive fibers formed into a sheet. More specifically, a non-woven cloth of extremely fine fibers formed into a sheet is impregnated with a conductive polymer. Note that a form other than a non-woven fabric, such as short conductive fibers woven into a woven cloth or knitted cloth may be used instead. The short conductive fibers contained in the static elimination strip 70 can produce a corona discharge at a low voltage because there are many sections that can easily concentrate the charge like a so-called needle electrode. The static elimination strip 70 therefore has a contactless static elimination function that by means of a corona discharge can remove the charge from a charged object without contacting the object. The charge can therefore be removed from charged ink droplets contactlessly. The static elimination strip 70 also has an adhesive layer on the back of the non-woven cloth containing the short conductive fibers, and can be provided in a form for use as a static elimination tape.

As described above, because the printer 1 according to this embodiment has a first static elimination strip 71 affixed to the side 27*c* of the protrusion 27*b* disposed to the bottom 27*a* of the carriage 27, the charge can be eliminated from the fine ink droplets that separate from the ink droplets ejected from the nozzle face 22*a*. These ink droplets that conventionally become ink mist can land more easily on the printing paper with the main ink droplets, and suspension of fine ink droplets can be suppressed. Furthermore, because the charge of any fine ink droplets that do become suspended can be suppressed, problems resulting from the ink droplets being attracted to parts with a static charge can be suppressed. Yet further, this can be achieved by simply affixing the first static elimination strip 71, there is no need for a ground connection, and configuration is therefore simple.

The side 27*c* to which the first static elimination strip 71 is affixed in the printer 1 according to this embodiment is the side facing the direction of travel when the carriage 27 moves to the away position AP side. If the first static elimination strip 71 is affixed to this side 27*c*, the charge can be eliminated from ink droplets produced by the flushing operation at the boundary between the main conveyance path 13 and the home position HP when the flushing operation ejecting ink from the printhead 22 to the maintenance mechanism 50 is performed at the home position HP in the standby mode. Ink mist produced by the flushing operation flowing to the main conveyance path 13 can therefore be suppressed. In addition, because the side facing the away position AP is the part facing the path of ink droplets suspended inside the case, the charge can eliminated from suspended ink droplets by disposing the first static elimination strip 71 here. Furthermore, because negative pressure is produced around the side 27*c* where the first static elimination strip 71 is affixed when the printhead 22 and carriage 27 move toward the away position AP during the printing operation, the charge can be effectively eliminated from minute ink droplets produced when ink is ejected toward the printing paper P. Ink droplets becoming suspended while still charged can therefore be suppressed.

The static elimination strip 70 may be affixed to another side of the carriage 27 positioned above the protrusion 27*b*. For example, the static elimination strip 70 may be affixed to the side of the carriage 27 facing the direction of travel when moving to the home position HP side (the one side of the carriage path S). When the static elimination strip 70 is affixed to the side of the carriage 27 facing the home position HP side, negative pressure is produced around the static elimination strip 70 when the printhead 22 and carriage 27 return to the home position HP. Suspension of ink droplets produced by ejecting ink while the printhead 22 and carriage 27 return to the home position HP can therefore be suppressed. The static elimination strip 70 may also be affixed to both the side facing the home position HP side and the side 27*c* facing the away position AP side.

Variations of Embodiment 1

A first embodiment of the invention is described above, but the above first embodiment can be varied in many ways without departing from the scope of the invention. Examples of variations of the first embodiment are described below.

Variation 1 of Embodiment 1

Figure 6:
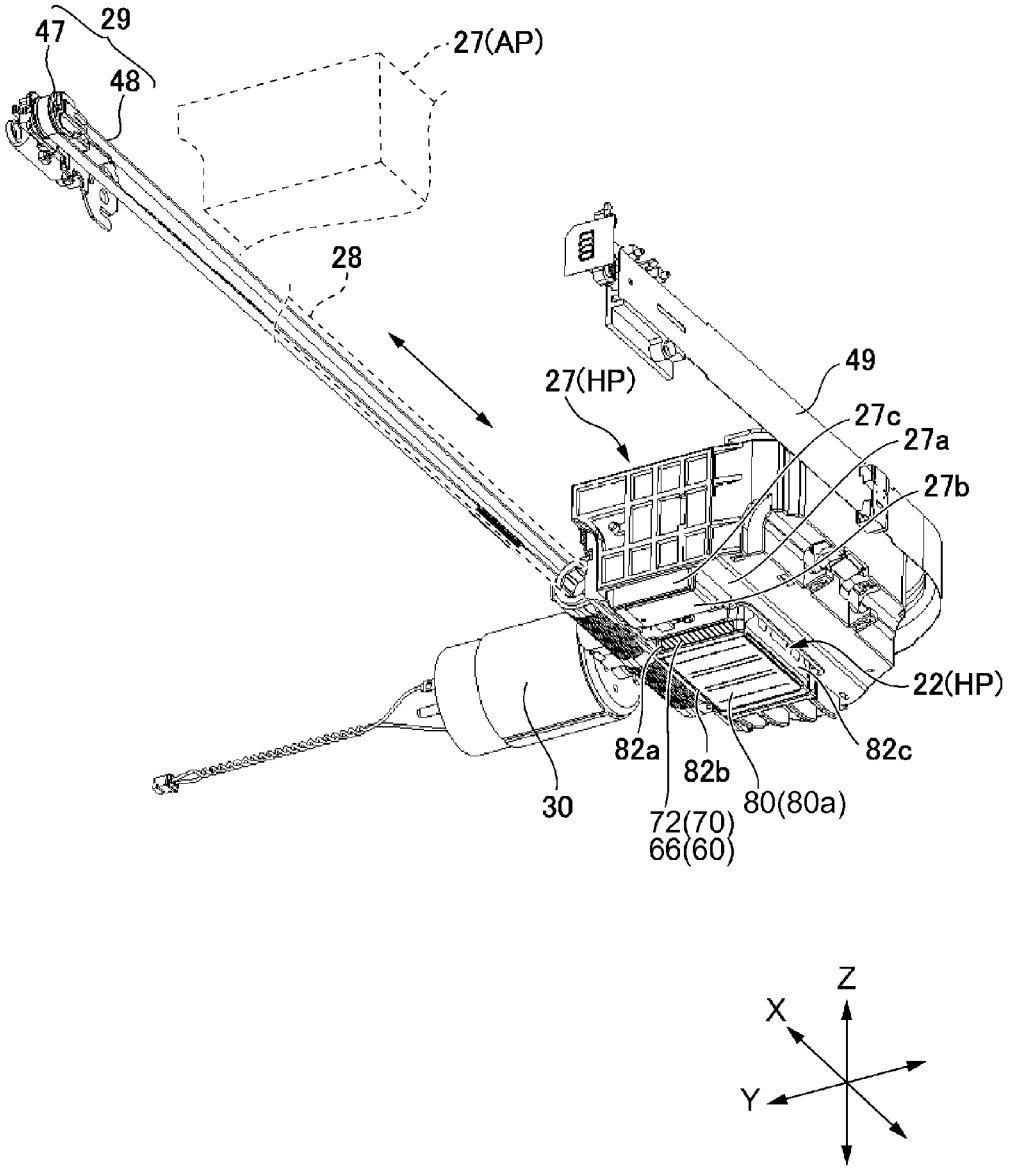
FIG. 6 is an oblique view showing where a static elimination strip is attached.

A first variation is described with reference to FIG. 6. FIG. 6 is an oblique view showing where the static elimination strip is affixed in this first variation. The transverse axis X, longitudinal axis Y, and vertical axis Z shown in FIG. 6 are identical to the transverse axis X, longitudinal axis Y, and vertical axis Z shown in FIG. 1.

As described above, the nozzle plate 80 portion of the printhead 22 protrudes down on the vertical axis Z from the bottom 27*a* of the carriage 27. As shown in FIG. 5 and FIG. 6, three sides of the nozzle plate 80, specifically the side 82*a* facing the direction of travel (transverse axis X) when moving to the away position AP side, and sides 82*b*, 82*c* adjacent to side 82*a*, are exposed to the outside. The side located at the opposite end as side 82*a* is covered by ribs that project down on the vertical axis Z.

In this example, as shown in FIG. 6, a second static elimination strip 72 is affixed to the side 82*a* of the nozzle plate 80, that is, the part of the printhead 22 that faces the direction of travel when moving to the away position AP side. When part of the side of the printhead 22 is thus exposed to the outside, the same effect as described above can be achieved by affixing a second static elimination strip 72 to that side. If the side of the nozzle plate 80 that faces the direction of travel when moving to the home position HP side is exposed to the outside, a second static elimination strip 72 can also be affixed to that side. Yet further, a second static elimination strip 72 can be affixed to both the side of the carriage 27 and the side of the printhead (nozzle plate 80).

Variation 2 of Embodiment 1

Figure 7:
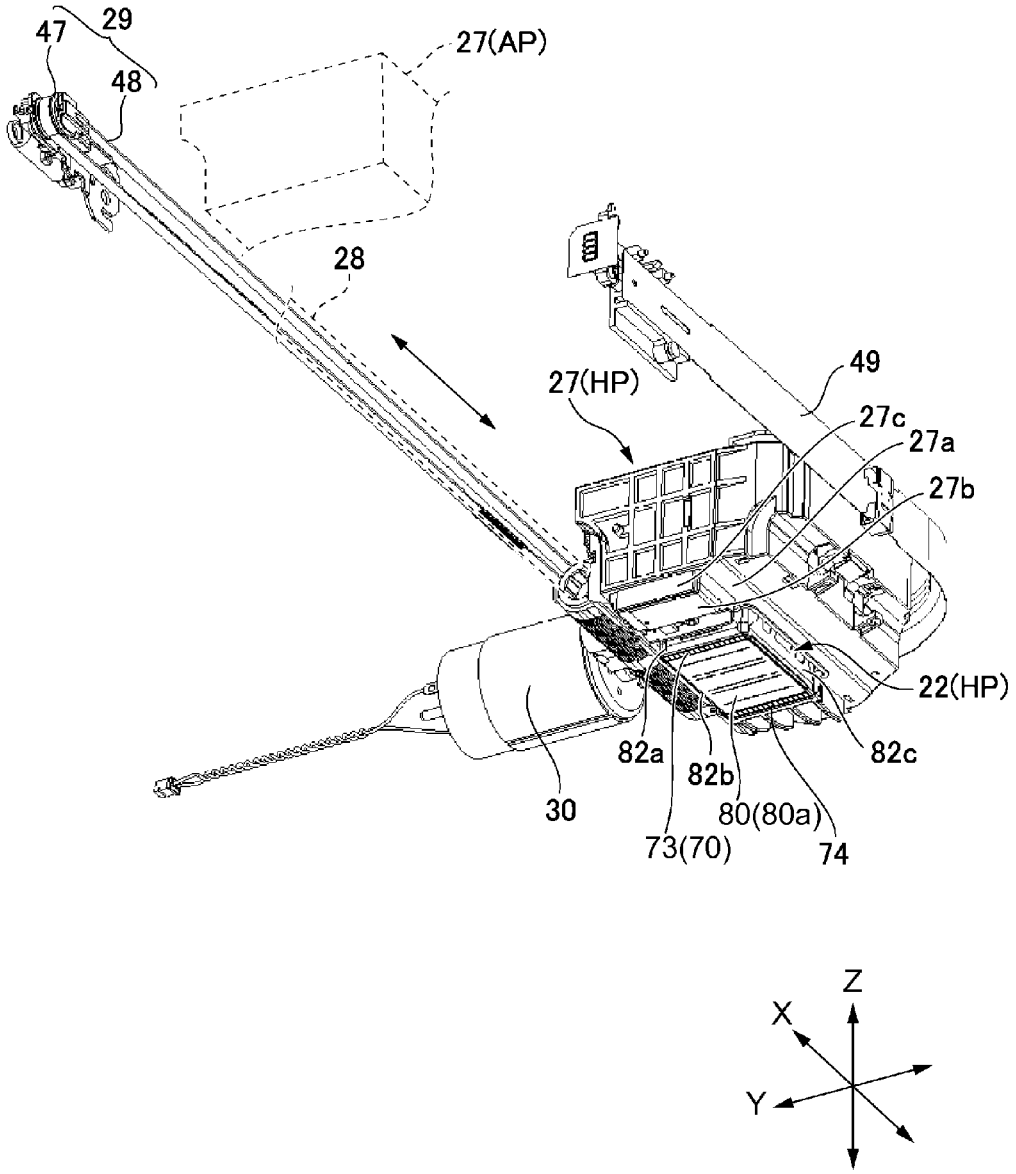
FIG. 7 is an oblique view showing where a static elimination strip is attached.

A second variation is described with reference to FIG. 7. FIG. 7 is an oblique view showing where the static elimination strip is affixed in this second variation. The transverse axis X, longitudinal axis Y, and vertical axis Z shown in FIG. 7 are identical to the transverse axis X, longitudinal axis Y, and vertical axis Z shown in FIG. 1.

The nozzle plate 80 has a bottom 80*a* where the ink nozzles are formed. As shown in FIG. 7, a third static elimination strip 73 and a fourth static elimination strip 74 are affixed to the bottom 80*a* in this second variation. The third static elimination strip 73 is affixed to the end of the bottom 80*a* on the away position AP side, and the fourth static elimination strip 74 is affixed to the end of the bottom 80*a* on the home position HP side. The third static elimination strip 73 and the fourth static elimination strip 74 are disposed so that the area where the ink nozzles are formed in the bottom 80*a* is between them from opposite sides in the scanning direction of the printhead 22. The ink droplet charge can thus be eliminated at a position closest to where the ink droplets are ejected from the ink nozzles, and the charge can be eliminated when the fine ink droplets separated from the main ink droplets that are ejected.

Variation 3 of Embodiment 1

Figure 8:
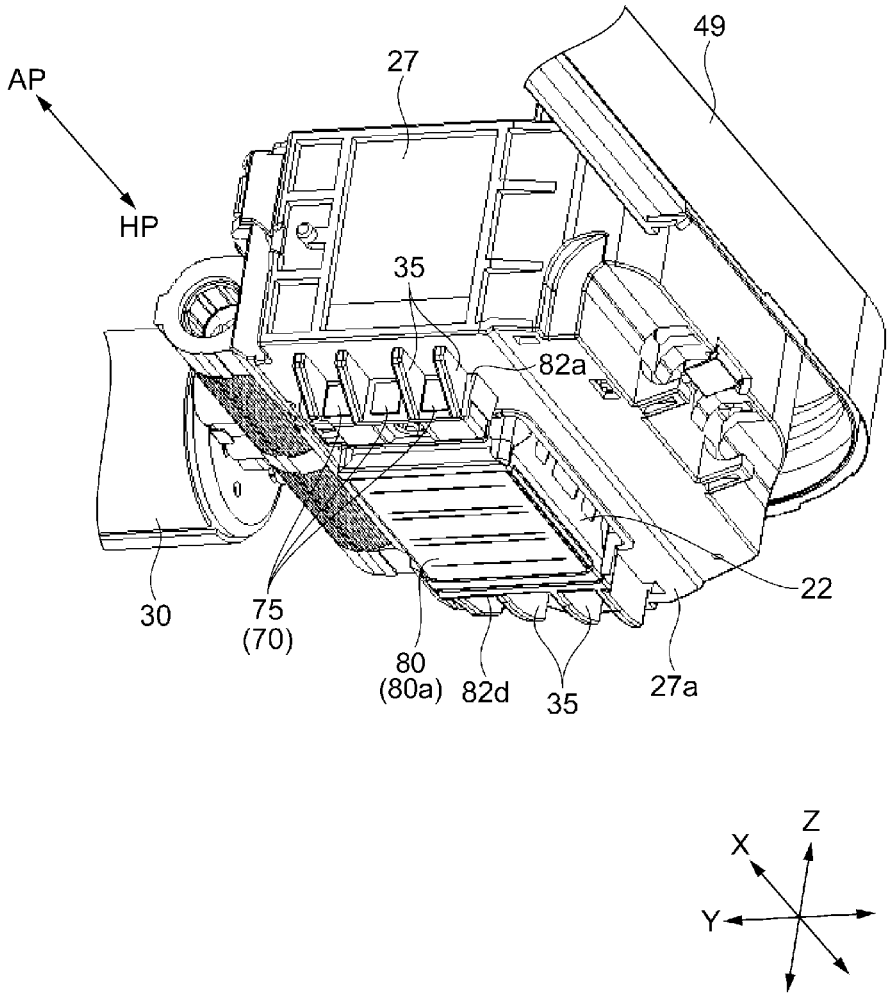
FIG. 8 is an oblique view showing where a static elimination strip is attached.

A third variation is described with reference to FIG. 8. FIG. 8 is an oblique view showing where the static elimination strip is affixed in this third variation. The transverse axis X, longitudinal axis Y, and vertical axis Z shown in FIG. 8 are identical to the transverse axis X, longitudinal axis Y, and vertical axis Z shown in FIG. 1.

As described above, the nozzle plate 80 portion of the printhead 22 protrudes down on the vertical axis Z from the bottom 27*a* of the carriage 27. However, the printhead 22 may also be modified in many ways according to the application of the printer 1 and the type of printing paper P used. For example, as shown in FIG. 8, the side 82*a* of the nozzle plate 80 facing the direction of travel (transverse axis X) when moving to the away position AP side, and the side 82*d* of the nozzle plate 80 facing the direction of travel (transverse axis X) when moving to the home position HP side, are covered by plural ribs 35 that project down on the vertical axis Z from the bottom 27*a* of the carriage 27.

These ribs 35 are provided to prevent paper jams and other problems resulting from interference with the sides 82*a*, 82*d* of the nozzle plate 80 if the printing paper P lifts up when the carriage 27 moves on the transverse axis X. When these ribs 35 are provided, a fifth static elimination strip 75 may be affixed to the sides 82*a*, 82*d* of the nozzle plate 80 between adjacent ribs 35. The same effect as described above can be achieved by thus affixing fifth static elimination strips 75.

Embodiment 2

Figure 9:
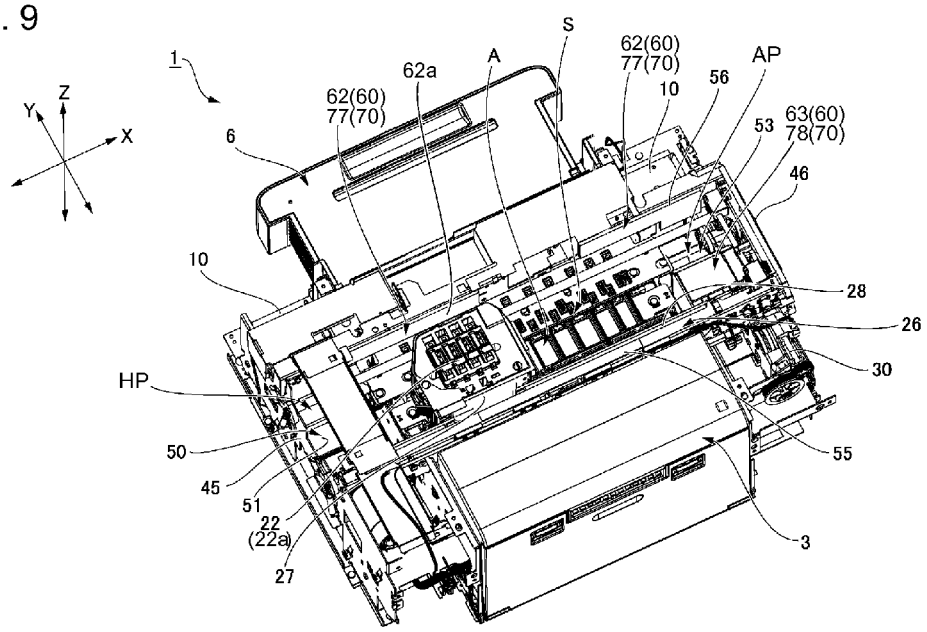
FIG. 9 is an oblique view from the back of the printer showing the printer with the outside cover removed.

A second embodiment of the invention is described next with reference to FIG. 4 and FIG. 9. The printer according to the second embodiment of the invention is another example applying a static elimination member as an ink mist countermeasure. FIG. 9 is an oblique view from the back of the printer showing the printer according to the second embodiment of the invention with the outside cover removed, and more specifically shows the printer from a different angle than in FIG. 3. The transverse axis X, longitudinal axis Y, and vertical axis Z shown in FIG. 9 are identical to the transverse axis X, longitudinal axis Y, and vertical axis Z shown in FIG. 1. Note that parts and content that are the same as in the first embodiment are identified by like reference numerals.

Path of the Head Moving Mechanism and Printhead

The path of the head moving mechanism and printhead in the second embodiment shown in FIG. 4 and FIG. 9 is substantially the same in configuration and function as the path of the head moving mechanism and printhead in the first embodiment.

As shown in FIG. 4 and FIG. 9, the away position AP of the printhead 22 is between the main conveyance path 13 and the second side frame 46. The away position AP is a space for moving the printhead 22 to the outside of the main conveyance path 13 when printing at the edge of the width of the printing paper P when the printhead 22 moves on the transverse axis X and prints on the printing paper conveyed through the main conveyance path 13. A bottom frame 53 (see FIG. 9) that can oppose the nozzle face 22*a* of the printhead 22 set to the away position AP is disposed to the away position AP.

The printhead 22 moves bidirectionally in a line along the carriage guide rail 28 between the home position HP and the away position AP. The contiguous space between the home position HP and the away position AP and including the home position HP and the away position AP is therefore the path S of the printhead 22.

Note that the printer 1 according to this embodiment has a rear frame 55 connecting the tops of the first side frame 45 and second side frame 46 at a position behind the carriage path S, that is, at a position closer to the back of the printer than the timing belt 48. A front frame 56 connects the tops of the first side frame 45 and second side frame 46 at a position in front of the carriage path S, that is, at a position closer to the front of the printer than the printhead 22. The rear frame 55 and front frame 56 extend parallel to each other on the transverse axis X. The front frame 56 supports part of the flexible ink path 49 that supplies ink to the printhead 22.

Static Elimination Member

In a printer 1 having an inkjet head as the printhead 22, a portion of the ink droplets ejected from the printhead 22 may become ink mist before reaching the printing paper P or the head cap 51 during the printing operation and flushing operation and becoming suspended inside the outside case 9. These suspended ink droplets (ink mist) may land on and soil other parts inside the outside case 9. Furthermore, because the ink mist is charged by the charge of the nozzle face 22*a* of the printhead 22 or the charge of the platen 25, the ink mist may land on and cause problems with charged components such as the control board and sensors, including the paper end sensor 20.

To address this problem, the printer 1 according to this second embodiment has a static elimination strip 70 (sixth to eighth static elimination strips 76, 77, 78) attached as a static elimination member at plural places inside the outside case 9 to contactlessly eliminate the charge of the ink droplets. Each of the plural static elimination strips 70 is attached to a position with one side facing the printhead 22. More specifically, one side of each static elimination strip 70 is exposed to the carriage path S.

As shown in FIG. 4, the sixth static elimination strip 76 is affixed with adhesive to the rear frame 55. Because the rear frame 55 extends along the carriage path S of the printhead 22, the surface of the sixth static elimination strip 76 can be exposed to the carriage path S through a wide area by affixing the sixth static elimination strip 76 to the rear frame 55. Air flow from the movement of the printhead 22 can easily suspend ink mist in the carriage path S. Therefore, by affixing the sixth static elimination strip 76 to the rear frame 55, the charge of the suspended ink droplets can be contactlessly removed.

Static electricity is also easily produced between the carriage guide rail 28 and carriage 27 by friction therebetween. The carriage guide rail 28 is therefore easily charged, and charged ink mist is attracted to the area of the carriage guide rail 28. Friction between the timing belt 48 and timing pulleys 47 can also easily produce static electricity therebetween. The timing belt 48 is therefore easily charged, and charged ink droplets are attracted to the area of the timing belt 48. Therefore, by disposing the sixth static elimination strip 76 facing the carriage guide rail 28, the charge of the suspended ink droplets can be contactlessly removed. Ink droplets landing on parts inside the printer 1 can therefore be reduced, and the ink droplets can be induced to land on and be discharged with the recording medium.

As shown in FIG. 9, a seventh static elimination strip 77 is affixed by adhesive to the front frame 56. Because the front frame 56 extends along the carriage path S, the surface of the seventh static elimination strip 77 can be exposed to the carriage path S through a wide area by affixing the seventh static elimination strip 77 to the front frame 56. Furthermore, because the front frame 56 is located near the printhead 22, the charge of ink droplets suspended by the air flow produced by the movement of the printhead 22 can be contactlessly removed by affixing the seventh static elimination strip 77 to the front frame 56.

The eighth static elimination strip 78 is affixed to the bottom frame 53 at the away position AP by adhesive. The away position AP is a space for retracting the printhead 22, and this space easily becomes a path for air flow. Therefore, the charge of ink droplets can be contactlessly removed by affixing the eighth static elimination strip 78 to the bottom frame 53 with the surface of the eighth static elimination strip 78 facing the printhead 22. As a result, movement of ink droplets charged through this space to somewhere else inside the outside case 9 can be prevented or suppressed.

Variations of Embodiment 2

A second embodiment of the invention is described above, but the above second embodiment can be varied in many ways without departing from the scope of the invention. Examples of variations of the second embodiment are described below.

Variation 1 of Embodiment 2

The second embodiment described above has sixth to eighth static elimination strips 76 to 78 disposed to the rear frame 55, front frame 56, and bottom frame 53, but is not limited thereto. The charge of ink droplets can be contactlessly removed if a static elimination strip 70 is disposed to at least one of these frame members.

Variation 2 of Embodiment 2

In addition to the rear frame 55, front frame 56, and bottom frame 53, a static elimination strip 70 may be affixed to at least one of a surface of the first side frame 45 on the home position HP side, and a surface of the second side frame 46 on the away position AP side. Thus comprised, the charge of ink droplets moving forward in the direction of travel by the positive pressure accompanying movement of the printhead 22 on the transverse axis X, and the charge of ink droplets dispersed to the back opposite the direction of travel by the negative pressure accompanying movement of the printhead 22, can be contactlessly removed by the static elimination strip 70.

Embodiment 3

Figure 10:
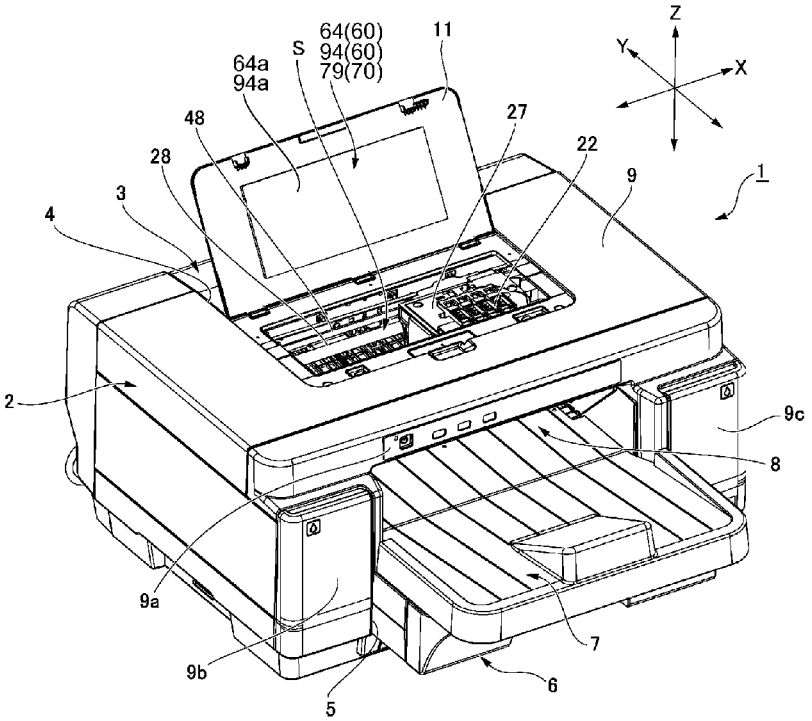
FIG. 10 is an oblique view of the printer with the access cover open.

A third embodiment of the invention is described next with reference to FIG. 10. The printer according to the third embodiment of the invention is also an example applying a static elimination member as an ink mist countermeasure. FIG. 10 is an oblique view of the printer according to the third embodiment of the invention with the access cover open. Note that parts and content that are the same as in the first embodiment and second embodiment are identified by like reference numerals and further description thereof is omitted.

The second embodiment is described with sixth to eighth static elimination strips 76 to 78 disposed to the rear frame 55, front frame 56, and bottom frame 53, but the invention is not limited thereto. As shown in FIG. 9, the printer 1 according to the third embodiment of the invention may have a ninth static elimination strip 79 affixed to the inside of the access cover 11 disposed to the outside case 9. The access cover 11 opens part of the area above the carriage path S of the printhead 22, and is opened and closed to remove the printing paper P from the main conveyance path 13 and recover when the printing paper P jams at the printing position A, for example. Because the access cover 11 is disposed near the carriage path S, the surface of the ninth static elimination strip 79 can be exposed to the carriage path S if it is affixed to the inside surface of the access cover 11. The charge of ink droplets suspended by the air flow produced in conjunction with movement of the printhead 22 can therefore be contactlessly removed by the ninth static elimination strip 79.

Embodiment 4

A printer as a fluid ejection device according to a fourth embodiment of the invention is described next with reference to FIG. 4 and FIG. 9. The printer according to the fourth embodiment is also an example applying a static elimination member as an ink mist countermeasure. Note that parts and content that are the same as in the first to third embodiments are identified by like reference numerals and further description thereof is omitted.

Static Elimination Member

In a printer 1 having an inkjet head as the printhead 22, a portion of the ink droplets ejected from the printhead 22 may become ink mist before reaching the printing paper P or the head cap 51 during the printing operation and flushing operation and becoming suspended inside the outside case 9. The suspended ink mist may land on and soil other parts inside the outside case 9. Furthermore, because the ink mist is charged by the charge of the nozzle face 22*a* of the printhead 22 or the charge of the platen 25, the ink mist may land on and cause problems with charged components such as the control board and sensors, including the paper end sensor 20.

To address this problem, the printer 1 according to this embodiment has a charged filter 60 (first to third charged filters 61, 62, 63) attached at plural places inside the outside case 9 as a static elimination member to capture ink mist. Note that charged filter 60 is used below when referring to the charged filters generally, and first charged filter 61, second charged filter 62, third charged filter 63, and so forth is used when referring to individual charged filters.

Each charged filter 60 is made from a porous electret such as a non-woven cloth of polypropylene or other thermoplastic resin. An electret is a dielectric with persistent electric polarization. The first to third charged filters 61, 62, 63 are sheets, and their front and back sides are referred to as a single surface as filter surfaces 61*a*, 62*a*, 63*a*.

Charged filters 60 are commercially available and are used to capture and remove airborne dust, but the inventors also discovered that a charged filter 60 also excels at capturing ink mist. More specifically, the inventors experimentally verified that ink mist is easily captured by a charged filter 60. By using a charged filter 60, ink mist can be captured without complicating the construction of the printer 1 and without consuming electricity.

Each of the first to third charged filters 61, 62, 63 is disposed to a position with the respective filter surfaces 61*a*, 62*a*, 63*a* facing the printhead 22. More specifically, the filter surfaces 61*a*, 62*a*, 63*a* of the first to third charged filters 61, 62, 63 are exposed to the carriage path S.

As shown in FIG. 4, the first charged filter 61 is affixed with adhesive to the rear frame 55. Because the rear frame 55 extends along the carriage path S of the printhead 22, the filter surface 61*a* can be exposed to the carriage path S through a wide area by affixing the first charged filter 61 to the rear frame 55. Air flow from the movement of the printhead 22 can easily suspend ink mist in the carriage path S. Therefore, by affixing the first charged filter 61 to the rear frame 55, suspended ink mist can be easily captured.

Static electricity is also easily produced between the carriage guide rail 28 and carriage 27 by friction therebetween. The carriage guide rail 28 is therefore easily charged, and charged ink mist is attracted to the area of the carriage guide rail 28. Friction between the timing belt 48 and timing pulleys 47 can also easily produce static electricity therebetween. The timing belt 48 is therefore easily charged, and charged ink droplets are attracted to the area of the timing belt 48. Therefore, by affixing the first charged filter 61 to a position facing the carriage guide rail 28, ink mist can be easily captured.

As shown in FIG. 9, second charged filter 62 is affixed by adhesive to the front frame 56. Because the front frame 56 extends along the carriage path S, the filter surface 62*a* of the second charged filter 62 can be exposed to the carriage path S through a wide area by affixing the second charged filter 62 to the front frame 56. Furthermore, because the front frame 56 is located near the printhead 22, ink mist suspended by the air flow produced by the movement of the printhead 22 can be easily captured by affixing the second charged filter 62 to the front frame 56.

The third charged filter 63 is affixed to the bottom frame 53 at the away position AP by adhesive. The away position AP is a space for retracting the printhead 22, and this space easily becomes a path for air flow. Therefore, ink mist can be easily captured by affixing the third charged filter 63 to the bottom frame 53 with the filter surface 63*a* facing the printhead 22, and movement of ink mist through this space to somewhere else inside the outside case 9 can be prevented or suppressed.

Variations of Embodiment 4

A fourth embodiment of the invention is described above, but the above fourth embodiment can be varied in many ways without departing from the scope of the invention. Examples of variations of the fourth embodiment are described below.

Variation 1 of Embodiment 4

The fourth embodiment described above has first to third charged filters 61, 62, 63 disposed to the rear frame 55, front frame 56, and bottom frame 53, but is not limited thereto. Ink mist can be easily captured by disposing a charged filter 60 to at least one of these frame members.

Variation 2 of Embodiment 4

In addition to the rear frame 55, front frame 56, and bottom frame 53, a charged filter 60 may be affixed to at least one of a surface of the first side frame 45 on the home position HP side, and a surface of the second side frame 46 on the away position AP side. Thus comprised, ink mist moving forward in the direction of travel by the positive pressure accompanying movement of the printhead 22 on the transverse axis X, and ink mist dispersed to the back opposite the direction of travel by the negative pressure accompanying movement of the printhead 22, can be easily captured by the charged filter 60.

Variation 3 of Embodiment 4

The fourth embodiment described above has first to third charged filters 61, 62, 63 affixed by adhesive to the frames 53, 55, 56, but is not limited thereto. The first to third charged filters 61, 62, 63 may be removably attached to the frames 53, 55, 56. In this configuration, the first to third charged filters 61, 62, 63 are held in shallow trays, and the trays can be removably attached to the frames 53, 55, 56. By removably attaching the first to third charged filters 61, 62, 63, the first to third charged filters 61, 62, 63 soiled by captured ink mist can be easily replaced with new charged filters 60.

Embodiment 5

A fifth embodiment of the invention is described next with reference to FIG. 10. An example in which first to third charged filters 61, 62, 63 are disposed to the rear frame 55, front frame 56, and bottom frame 53 is described in the fourth embodiment, but the invention is not so limited. As shown in FIG. 10, a fourth charged filter 64 may be affixed to the inside of the access cover 11 disposed to the outside case 9 in the printer 1 according to the third embodiment of the invention. The access cover 11 opens part of the area above the carriage path S of the printhead 22, and is opened and closed to remove the printing paper P from the main conveyance path 13 and recover when the printing paper P jams at the printing position A, for example. Because the access cover 11 is disposed near the carriage path S, the filter surface 64*a* can be exposed to the carriage path S if the fourth charged filter 64 is affixed to the inside surface of the access cover 11. Ink mist suspended by the air flow produced in conjunction with movement of the printhead 22 can therefore be easily captured by the fourth charged filter 64. Furthermore, because the fourth charged filter 64 is exposed to the outside of the outside case 9 when the access cover 11 opens, the fourth charged filter 64 can be easily replaced if it is removably installed to the access cover 11.

Embodiment 6

A sixth embodiment of the invention is described next with reference to FIG. 5. FIG. 5 is an oblique view of the printhead, head moving mechanism, and ink path in the printer shown in FIG. 1 from diagonally below the front of the printer specifically when the printhead and carriage are in the home position. Note that parts and content that are the same as in the first to fifth embodiments are identified by like reference numerals and further description thereof is omitted.

The inventors discovered through tests that a charged filter 60 excels at capturing ink mist when a charged filter 60 is disposed as a charged member to the carriage 27 that carries the printhead 22 or the printhead 22, and not only in the path of the carriage 27 that carries the printhead 22. The printer 1 according to the third embodiment of the invention is an example having the charged filter 60 disposed to the carriage 27 that carries the printhead 22 or the printhead 22. Details thereof are described below.

Location of the Charged Member

In a printer 1 according to the sixth embodiment of the invention, a charged filter 60 (fifth charged filter 65) is attached as a charged member to the side of the carriage 27.

As shown in FIG. 5, an opening is formed in the middle of the bottom 27*a* of the carriage 27, and the nozzle plate 80 disposed to the bottom end of the printhead 22 protrudes down on the vertical axis Z from this opening. Ink nozzles are formed in the bottom 80*a* of the nozzle plate 80, and the bottom 80*a* embodies the nozzle face 22*a* of the printhead 22.

A rectangular protrusion 27*b* that protrudes down is formed to the bottom. 27*a* of the carriage 27 at a position near the away position AP side of the nozzle plate 80. The fifth charged filter 65 is affixed to the side 27*c* of the protrusion 27*b* facing the away position AP. This side 27*c* is the side facing the direction of travel when the printhead 22 and carriage 27 move to the away position AP side (to the other end of the carriage path S). The distance the protrusion 27*b* projects from the bottom 27*a* is less than the nozzle plate 80, and the side 27*c* is above the nozzle face 22*a* on the vertical axis Z.

Because the printer 1 according to the sixth embodiment of the invention has a fifth charged filter 65 affixed to the side 27*c* of the protrusion 27*b* disposed to the bottom 27*a* of the carriage 27, ink mist separating from the ink droplets ejected from the nozzle face 22*a* can be captured. As a result, suspension of minute ink droplets can be suppressed.

The side 27*c* to which the fifth charged filter 65 is affixed in the printer 1 is the side facing the direction of travel when the carriage 27 moves to the away position AP side. If the fifth charged filter 65 is affixed to this side 27*c*, ink mist produced by the flushing operation at the boundary between the main conveyance path 13 and the home position HP can be captured when the flushing operation ejecting ink from the printhead 22 to the maintenance mechanism 50 is performed at the home position HP in the standby mode.

Ink mist produced by the flushing operation flowing to the main conveyance path 13 can therefore be suppressed. In addition, because the side facing the away position AP is the part facing the path of ink droplets suspended inside the case, ink mist can be captured by disposing the fifth charged filter 65 here. Furthermore, because negative pressure is produced around the side 27*c* where the fifth charged filter 65 is affixed when the printhead 22 and carriage 27 move toward the away position AP during the printing operation, ink mist produced when ink is ejected toward the printing paper P can be effectively captured.

The charged filter 60 may be affixed to another side of the carriage 27 positioned above the protrusion 27*b*. For example, the charged filter 60 may be affixed to the side of the carriage 27 facing the direction of travel when moving to the home position HP side (the one side of the carriage path S). When the charged filter 60 is affixed to the side of the carriage 27 facing the home position HP side, negative pressure is produced around the charged filter 60 when the printhead 22 and carriage 27 return to the home position HP. Suspension of ink droplets produced by ejecting ink while the printhead 22 and carriage 27 return to the home position HP can therefore be suppressed. The charged filter 60 may also be affixed to both the side facing the home position HP side and the side 27*c* facing the away position AP side.

Variations of Embodiment 6

A sixth embodiment of the invention is described above, but the above sixth embodiment can be varied in many ways without departing from the scope of the invention. Examples of variations of the sixth embodiment are described below.

Variation 1 of Embodiment 6

A first variation is described with reference to FIG. 6. As described above, the nozzle plate 80 portion of the printhead 22 protrudes from the bottom 27*a* of the carriage 27. As shown in FIG. 5 and FIG. 6, three sides of the nozzle plate 80, specifically the side 82*a* facing the direction of travel when moving to the away position AP side, and sides 82*b*, 82*c* adjacent to side 82*a*, are exposed to the outside. The side located at the opposite end as side 82*a* is covered by ribs that project down from the bottom of the carriage 27.

In this example, as shown in FIG. 6, a sixth charged filter 66 is affixed to the side 82*a* of the nozzle plate 80, that is, the part of the printhead 22 that faces the direction of travel when moving to the away position AP side. When part of the side of the printhead 22 is thus exposed to the outside, the same effect as described above can be achieved by affixing a charged filter 60 to that side. If the side of the nozzle plate 80 that faces the direction of travel when moving to the home position HP side is exposed to the outside, a charged filter 60 can also be affixed to that side. Yet further, a charged filter 60 can be affixed to both the side of the carriage 27 and the side of the printhead 22 (nozzle plate 80).

Embodiment 7

A printer as an example of a fluid ejection device according to the seventh embodiment of the invention is described next. The printer according to the seventh embodiment is an example applying a static elimination member and a charged member as an ink mist countermeasure. Note that parts and content that are the same as in the first to sixth embodiments are identified by like reference numerals and further description thereof is omitted.

Location of a Static Elimination Member in Embodiment 7

Figure 11:
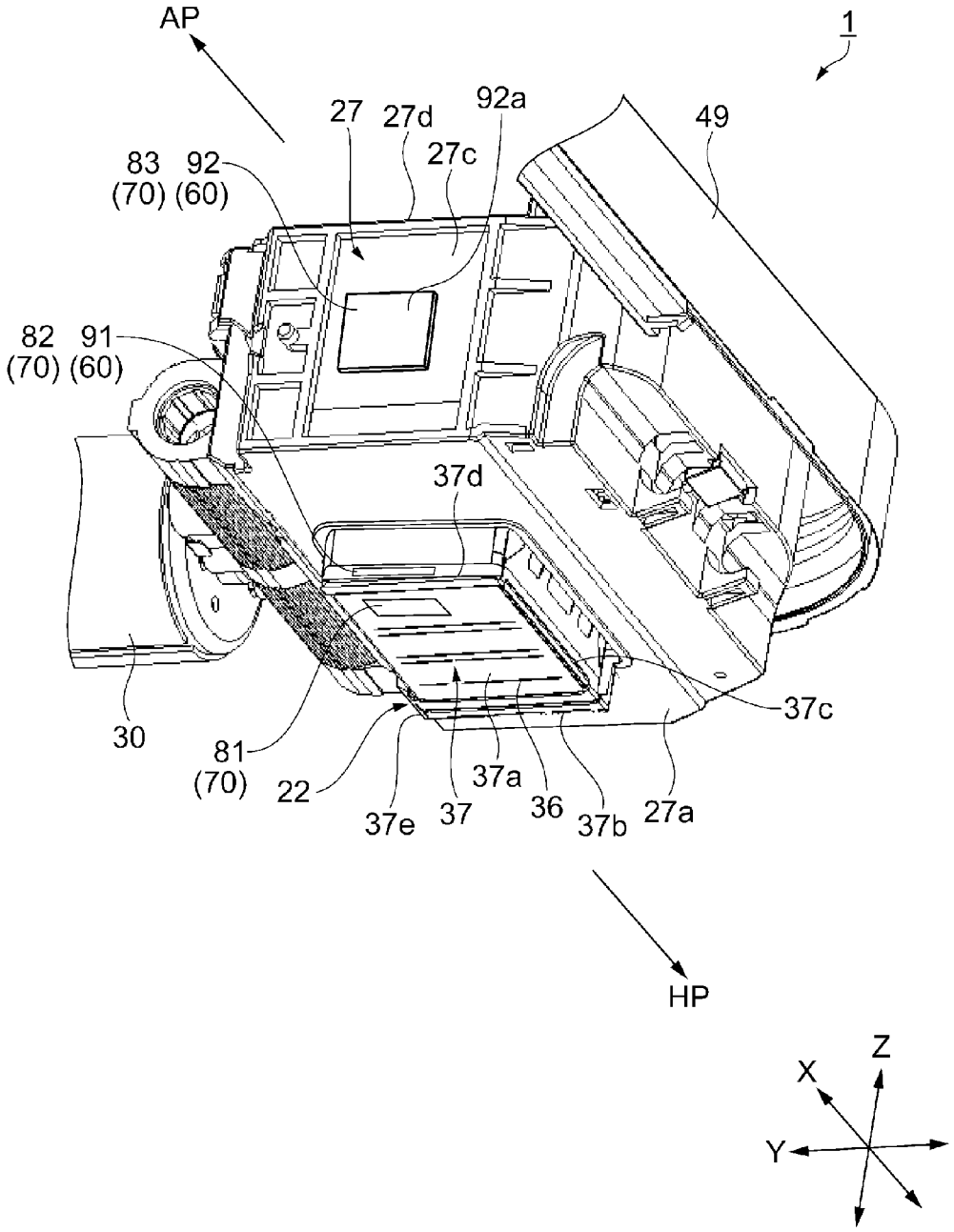
FIG. 11 is an oblique view of the printhead of the printer from below the printer front.

The location of a static elimination member in the seventh embodiment of the invention is described next. FIG. 11 is an oblique view of the printhead of the printer from below the front of the printer. The transverse axis X, longitudinal axis Y, and vertical axis Z shown in FIG. 11 are identical to the transverse axis X, longitudinal axis Y, and vertical axis Z shown in FIG. 1.

In printers having an inkjet head as the printhead 22, some ink droplets ejected from the printhead 22 may shed ink as the ink droplets fly toward the printing paper P during the printing operation and flushing operation, forming minute ink droplets that become suspended inside the outside case 9 before reaching the printing paper P or the head cap 51 (see FIG. 4). These minute suspended ink droplets may then land on and soil other parts inside the outside case 9. Furthermore, because the minute ink droplets become charged by the charge of the nozzle face 37*a* of the printhead 37 or the charge of the platen 25, they may land on and may cause problems with charged components such as the control board and sensors, including the paper end sensor 20.

As shown in FIG. 11, the nozzle plate 37 portion of the printhead 22 protrudes down on the vertical axis Z from the bottom 27*a* of the carriage 27. Nozzles 36 are formed in plural rows in the bottom of the nozzle plate 37, creating the nozzle face 37*a*. The nozzle plate 37 in this embodiment has a box-like shape with the nozzle face 37*a* at the bottom, and has plate surfaces 37*b*, 37*c*, 37*d* and 37*e* as the sides of the box. Note that these plate surfaces 37*b*-37*e* may be brackets that secure the nozzle face 37*a* instead of being formed in unison with the nozzle face 37*a*. In the printer 1 according to the seventh embodiment of the invention, a static elimination strip 70 (tenth static elimination strip 81) is affixed as a static elimination member that contactlessly eliminates the charge of the ink droplets near the outside perimeter of the nozzle face 37*a* of the nozzle plate 37 of the printhead 22 separated from the nozzles 36.

As described above, because the printer 1 according to this seventh embodiment has a tenth static elimination strip 81 affixed to the nozzle face 37*a* of the nozzle plate 37 of the printhead 22, the charge can be eliminated from the minute ink droplets that separate from the ink droplets ejected from the nozzles 36 of the nozzle face 37*a*. These ink droplets that conventionally become ink mist can land more easily on the printing paper with the main ink droplets, and suspension of minute ink droplets can be suppressed. Furthermore, because the charge can be suppressed in any minute ink droplets that do become suspended, problems resulting from the ink droplets being attracted to parts with a static charge can be suppressed. Yet further, this can be achieved by simply affixing the tenth static elimination strip 81, there is no need for a ground connection, and configuration is therefore simple. Note that the suspended minute ink droplets are referred to below as ink mist.

Location of the Charged Member in Embodiment 7

The location of the charged member in the seventh embodiment is described next. In a printer 1 having a static elimination strip 70 (tenth static elimination strip 81) affixed to the nozzle face 37*a* of the nozzle plate 37 of the printhead 22, a charged filter 60 (seventh charged filter 91, eighth charged filter 92) is affixed as a charged member that captures ink mist at a position far from the static elimination strip 70.

Note that the charged filter 60 used as a charged member is preferably disposed to a position that does not have the static elimination effect of the static elimination strip 70, As a result, if they are disposed in proximity, the performance and size of the static elimination strip 70, and the performance and size of the charged filter 60, are preferably coordinated.

Location of the Charged Member in Example 1 of Embodiment 7

The location of the charged member in a first example of the seventh embodiment is also described with reference to FIG. 11. As shown in FIG. 11, in a first example of the seventh embodiment, the charged filter 60 (seventh charged filter 91) is attached to one of the plate surfaces 37*b*-37*e*. In this example, the seventh charged filter 91 is shown attached to the plate surface 37*d*. Note that the seventh charged filter 91 may be affixed to one of plate surfaces 37*b*-37*e*, or to plural surfaces.

As a result, ink mist that could not be destaticized at the nozzle face 37*a* where the nozzles 36 from which the ink droplets are ejected are disposed can be captured by the seventh charged filter 91 disposed to the closest plate surfaces 37*b*-37*e*. Suspension of ink mist can therefore be effectively suppressed, and problems due to ink mist landing on parts inside the printer 1 can be suppressed.

Location of the Charged Member in Example 2 of Embodiment 7

The location of the charged member in a second example of the seventh embodiment is also described with reference to FIG. 11. As shown in FIG. 11, in a second example of the seventh embodiment, the charged filter 60 (eighth charged filter 92) is attached to at least one of the sides 27*c* of the carriage 27. The eighth charged filter 92 may be affixed to one side 27*c*, or to plural sides.

For example, as shown in FIG. 11, the eighth charged filter 92 may be affixed to the one side 27*c* facing the away position AP. This side 27*c* is the side facing the direction of travel when the printhead 22 and the carriage 27 move to the away position AP side.

Because the side facing the away position AP is the part facing the path of ink droplets suspended inside the case, suspended ink mist that could not be destaticized by the tenth static elimination strip 81 can be captured by disposing the eighth charged filter 92 here. Furthermore, because negative pressure is produced around the side 27*c* where the eighth charged filter 92 is affixed when the printhead 22 and carriage 27 move toward the away position AP during the printing operation, ink mist produced when ink is ejected toward the printing paper P can be effectively captured.

The eighth charged filter 92 may be affixed to another side 27*c* of the carriage 27. For example, the eighth charged filter 92 may be affixed to the side 27*c* of the carriage 27 facing the direction of travel when moving to the home position HP side. In this configuration, negative pressure is produced around the eighth charged filter 92 when the printhead 22 and carriage 27 return to the home position HP. Suspension of ink mist produced by ejecting ink while the printhead 22 and carriage 27 return to the home position HP can therefore be suppressed. The eighth charged filter 92 may also be affixed to both the side 27*c* facing the home position HP side and the side 27*c* facing the away position AP side.

Location of the Charged Member in Example 3 of Embodiment 7

The location of the charged member in a third example of the seventh embodiment is also described with reference to FIG. 4. In this third example of the seventh embodiment, the charged filter 60 (ninth charged filter 93) is affixed to the side of at least one of the first side frame 45, second side frame 46, rear frame 55, and front frame 56 facing the carriage path S of the carriage 27 shown in FIG. 3.

As shown in FIG. 4, the ninth charged filter 93 is affixed with adhesive to the rear frame 55. Because the rear frame 55 extends along the carriage path S of the printhead 22, the filter surface 93*a* can be exposed to the carriage path S through a wide area by affixing the ninth charged filter 93 to the rear frame 55. Air flow from the movement of the printhead 22 can easily suspend ink mist in the carriage path S. Therefore, by affixing the ninth charged filter 93 to the rear frame 55, suspended ink mist that could not be destaticized by the tenth static elimination strip 81 can be easily captured.

Static electricity is also easily produced between the carriage guide rail 28 and carriage 27 by friction therebetween. The carriage guide rail 28 is therefore easily charged, and ink mist that could not be destaticized by the tenth static elimination strip 81 is attracted to the area of the carriage guide rail 28. Friction between the timing belt 48 and timing pulleys 47 can also easily produce static electricity therebetween. The timing belt 48 is therefore easily charged, and charged ink mist is attracted to the area of the timing belt 48. Therefore, by affixing the ninth charged filter 93 to a position facing the carriage guide rail 28, ink mist can be easily captured.

In this third example, the ninth charged filter 93 is described affixed to the rear frame 55, but the invention is not so limited. The ninth charged filter 93 may be attached to any one of the first side frame 45, second side frame 46, rear frame 55, and front frame 56, or to plural frames. The ninth charged filter 93 may also be attached in segments to one frame.

Location of the Charged Member in Example 4 of Embodiment 7

A fourth example of the seventh embodiment is described with reference to FIG. 10. As shown in FIG. 10, the printer 1 according to the fourth example of the seventh embodiment may have a tenth charged filter 94 affixed to the inside of the access cover 11 disposed to the outside case 9. The access cover 11 opens part of the area above the path S of the printhead 22 (carriage 27), and is opened and closed to remove the printing paper P from the main conveyance path 13 and recover when the printing paper P jams at the printing position A, for example.

Because the access cover 11 is disposed near the carriage path S, the filter surface 94*a* can be exposed to the carriage path S if the tenth charged filter 94 is affixed to the inside surface of the access cover 11. Ink mist suspended by the air flow produced in conjunction with movement of the printhead 22 can therefore be captured by the tenth charged filter 94. Furthermore, because the tenth charged filter 94 is exposed to the outside of the outside case 9 when the access cover 11 opens, the tenth charged filter 94 can be easily replaced if it is removably installed to the access cover 11.

Embodiment 8

Location of the Static Elimination Member in Embodiment 8

The location of a static elimination member in the eighth embodiment of the invention is described next with reference to FIG. 11. Note that parts and content that are the same as in the first to seventh embodiments are identified by like reference numerals and further description thereof is omitted.

As shown in FIG. 11, the nozzle plate 37 portion of the printhead 22 protrudes down on the vertical axis Z from the bottom 27*a* of the carriage 27. Nozzles 36 are formed in plural rows in the bottom of the nozzle plate 37, creating the nozzle face 37*a*. The nozzle plate 37 in this embodiment has a box-like shape with the nozzle face 37*a* at the bottom, and has plate surfaces 37*b* to 37*e* as the sides of the box. Note that these plate surfaces 37*b*-37*e* may be brackets that secure the nozzle face 37*a* instead of being formed in unison with the nozzle face 37*a*. In the printer 1 according to the eighth embodiment of the invention, a static elimination strip 70 (eleventh static elimination strip 82) is affixed as a static elimination member that contactlessly eliminates the charge of the ink droplets on at least one of the plate surfaces 37*b*-37*e* of the nozzle plate 37 of the printhead 22. This eighth embodiment shows an example in which the eleventh static elimination strip 82 is attached to plate surface 37*d*.

As described above, because the printer 1 according to this eighth embodiment has an eleventh static elimination strip 82 affixed to the plate surface 37*d* of the nozzle plate 37 of the printhead 22, the charge can be eliminated from the ink mist that separates from the ink droplets ejected from the nozzles 36 of the nozzle face 37*a*. These ink droplets that conventionally become ink mist can land more easily on the printing paper with the main ink droplets, and suspension of minute ink droplets can be suppressed. Furthermore, because the charge of the ink droplets can be suppressed in any minute ink droplets that become suspended, problems resulting from the ink droplets being attracted to parts with a static charge can be suppressed. Yet further, this can be achieved by simply affixing the eleventh static elimination strip 82, there is no need for a ground connection, and configuration is therefore simple.

Location of the Charged Member in Embodiment 8

The location of the charged member in the eighth embodiment is described next. In a printer 1 having an eleventh static elimination strip 82 affixed to at least one plate surface 37*b*-37*e* of the nozzle plate 37 of the printhead 22, a charged filter 60 (eighth charged filter 92, ninth charged filter 93) is affixed as a charged member that captures ink mist at a position far from the eleventh static elimination strip 82.

Location of the Charged Member in Example 1 of Embodiment 8

The location of the charged member in a first example of the eighth embodiment is also described with reference to FIG. 11. As shown in FIG. 11, in a first example of the eighth embodiment, the eighth charged filter 92 is attached to at least one side 27*c* of the carriage 27. Note that the eighth charged filter 92 may be affixed to one side 27*c*, or to plural sides.

For example, as shown in FIG. 11, the eighth charged filter 92 may be affixed to the one side 27*c* facing the away position AP. This side 27*c* is the side facing the direction of travel when the printhead 22 and the carriage 27 move to the away position AP side. Because the side facing the away position AP is the part facing the path of ink droplets suspended inside the case, suspended ink mist that could not be destaticized by the eleventh static elimination strip 82 can be captured by disposing the eighth charged filter 92 here. Furthermore, because negative pressure is produced around the side 27*c* where the eighth charged filter 92 is affixed when the printhead 22 and carriage 27 move toward the away position AP during the printing operation, ink mist produced when ink is ejected toward the printing paper P can be effectively captured.

The eighth charged filter 92 may be affixed to another side 27*c* of the carriage 27. For example, the eighth charged filter 92 may be affixed to the side 27*c* of the carriage 27 facing the direction of travel when moving to the home position HP side. In this configuration, negative pressure is produced around the eighth charged filter 92 when the printhead 22 and carriage 27 return to the home position HP. Suspension of ink mist produced by ejecting ink while the printhead 22 and carriage 27 return to the home position HP can therefore be suppressed. The eighth charged filter 92 may also be affixed to both the side 27*c* facing the home position HP side and the side 27*c* facing the away position AP side.

Location of the Charged Member in Example 2 of Embodiment 8

The location of the charged member in a second example of the eighth embodiment is described with reference to FIG. 4. In this second example of the embodiment 8, the charged filter 60 (ninth charged filter 93) is affixed to the side of at least one of the first side frame 45, second side frame 46, rear frame 55, and front frame 56 facing the carriage path S of the carriage 27.

As shown in FIG. 4, the ninth charged filter 93 is affixed with adhesive to the rear frame 55. Because the rear frame 55 extends along the carriage path S of the printhead 22, the filter surface 93*a* can be exposed to the carriage path S through a wide area by affixing the ninth charged filter 93 to the rear frame 55. Air flow from the movement of the printhead 22 can easily suspend ink mist in the carriage path S. Therefore, by affixing the ninth charged filter 93 to the rear frame 55, suspended ink mist that could not be destaticized by the eleventh static elimination strip 82 can be easily captured.

Static electricity is also easily produced between the carriage guide rail 28 and carriage 27 by friction therebetween. The carriage guide rail 28 is therefore easily charged, and ink mist that could not be destaticized by the eleventh static elimination strip 82 is attracted to the area of the carriage guide rail 28. Friction between the timing belt 48 and timing pulleys 47 can also easily produce static electricity therebetween. The timing belt 48 is therefore easily charged, and charged ink mist is attracted to the area of the timing belt 48. Therefore, by affixing the ninth charged filter 93 to a position facing the carriage guide rail 28, ink mist can be easily captured.

In this third example, the ninth charged filter 93 is described affixed to the rear frame 55, but the invention is not so limited. The ninth charged filter 93 may be attached to any one of the first side frame 45, second side frame 46, rear frame 55, and front frame 56, or to plural frames. The ninth charged filter 93 may also be attached in segments to one frame.

Location of the Charged Member in Example 3 of Embodiment 8

A third example of the eighth embodiment is described with reference to FIG. 10. As shown in FIG. 10, the printer 1 according to the third example of the eighth embodiment may have a tenth charged filter 94 affixed to the inside of the access cover 11 disposed to the outside case 9. The access cover 11 opens part of the area above the path S of the printhead 22 (carriage 27), and is opened and closed to remove the printing paper P from the main conveyance path 13 and recover when the printing paper P jams at the printing position A, for example.

Because the access cover 11 is disposed near the carriage path S, the filter surface 94*a* can be exposed to the carriage path S if the tenth charged filter 94 is affixed to the inside surface of the access cover 11. Ink mist suspended by the air flow produced in conjunction with movement of the printhead 22 that cannot be completely destaticized by the eleventh static elimination strip 82 can therefore be captured by the tenth charged filter 94. Furthermore, because the tenth charged filter 94 is exposed to the outside of the outside case 9 when the access cover 11 opens, the tenth charged filter 94 can be easily replaced if it is removably installed to the access cover 11.

Embodiment 9

Location of the Static Elimination Member in Embodiment 9

The location of a static elimination member in the ninth embodiment of the invention is described next with reference to FIG. 11. Note that parts and content that are the same as in the first to eighth embodiments are identified by like reference numerals and further description thereof is omitted.

As shown in FIG. 11, in the ninth embodiment, a twelfth static elimination strip 83 is attached to at least one of the sides 27*c* of the carriage 27. The twelfth static elimination strip 83 may be affixed to one side 27*c*, or to plural sides.

For example, as shown in FIG. 11, the twelfth static elimination strip 83 may be affixed to the one side 27*c* facing the away position AP. This side 27*c* is the side facing the direction of travel when the printhead 22 and the carriage 27 move to the away position AP side. Because the side facing the away position AP is the part facing the path of ink droplets suspended inside the case, the charge can be eliminated from suspended ink mist by disposing the twelfth static elimination strip 83 here. Furthermore, because negative pressure is produced around the side 27*c* where the twelfth static elimination strip is affixed when the printhead 22 and carriage 27 move toward the away position AP during the printing operation, ink mist produced when ink is ejected toward the printing paper P is attracted thereto. As a result, the ink mist can be effectively destaticized.

The twelfth static elimination strip 83 may be affixed to another side 27*c* of the carriage 27. For example, the twelfth static elimination strip 83 may be affixed to the side 27*c* of the carriage 27 facing the direction of travel when moving to the home position HP side. In this configuration, negative pressure is produced around the twelfth static elimination strip 83 when the printhead 22 and carriage 27 return to the home position HP. Suspension of ink mist produced by ejecting ink while the printhead 22 and carriage 27 return to the home position HP can therefore be suppressed. The twelfth static elimination strip 83 may also be affixed to both the side 27*c* facing the home position HP side and the side 27*c* facing the away position AP side.

Location of the Charged Member in Embodiment 9

The location of the charged member in the ninth embodiment is described next. In a printer 1 having a twelfth static elimination strip 83 affixed to at least one side 27*c* of the carriage 27, a charged filter 60 (eighth charged filter 92, ninth charged filter 93) is affixed as a charged member that captures ink mist at a position far from the twelfth static elimination strip 83.

Location of the Charged Member in Example 1 of Embodiment 9

The location of the charged member in a first example of the ninth embodiment is described with reference to FIG. 4 and FIG. 11. As shown in FIG. 4 and FIG. 11, in the first example of the ninth embodiment, an eleventh charged filter 95 is disposed to the printhead 22 attached to the carriage 27 on the opposite side as the nozzle plate 37, that is, on the top 27*d* of the carriage 27. Thus comprised, suspended ink mist that rises and cannot be completely destaticized at the side 27*c* of the carriage 27 can be captured by the eleventh charged filter 95 disposed to the top 27*d* of the carriage 27 that carries the printhead 22. Furthermore, because the carriage 27 is exposed to the outside of the outside case 9 when the access cover 11 shown in FIG. 10 opens, the eleventh charged filter 95 can be easily replaced if it is removably installed to the top 27*d* of the carriage 27.

Location of the Charged Member in Example 2 of Embodiment 9

The location of the charged member in a second example of the ninth embodiment is described with reference to FIG. 4. In this second example of the ninth embodiment, the ninth charged filter 93 is affixed to the side of at least one of the first side frame 45, second side frame 46, rear frame 55, and front frame 56 facing the carriage path S of the carriage 27.

As shown in FIG. 4, the ninth charged filter 93 is affixed with adhesive to the rear frame 55. Because the rear frame 55 extends along the carriage path S of the printhead 22, the filter surface 93*a* can be exposed to the carriage path S through a wide area by affixing the ninth charged filter 93 to the rear frame 55. Air flow from the movement of the printhead 22 can easily suspend ink mist in the carriage path S. Therefore, by affixing the ninth charged filter 93 to the rear frame 55, suspended ink mist that could not be destaticized by the twelfth static elimination strip 83 can be easily captured.

Static electricity is also easily produced between the carriage guide rail 28 and carriage 27 by friction therebetween. The carriage guide rail 28 is therefore easily charged, and ink mist that could not be destaticized by the twelfth static elimination strip 83 is attracted to the area of the carriage guide rail 28. Friction between the timing belt 48 and timing pulleys 47 can also easily produce static electricity therebetween. The timing belt 48 is therefore easily charged, and charged ink mist is attracted to the area of the timing belt 48. Therefore, by affixing the ninth charged filter 93 to aposition facing the carriage guide rail 28, ink mist can be easily captured.

In this third example, the ninth charged filter 93 is described affixed to the rear frame 55, but the invention is not so limited. The ninth charged filter 93 may be attached to any one of the first side frame 45, second side frame 46, rear frame 55, and front frame 56, or to plural frames. The ninth charged filter 93 may also be attached in segments to one frame.

Location of the Charged Member in Example 3 of Embodiment 9

A third example of the ninth embodiment is described with reference to FIG. 10. As shown in FIG. 10, the printer 1 according to the third example of the ninth embodiment may have a tenth charged filter 94 affixed to the inside of the access cover 11 disposed to the outside case 9. The access cover 11 opens part of the area above the path S of the printhead 22 (carriage 27), and is opened and closed to remove the printing paper P from the main conveyance path 13 and recover when the printing paper P jams at the printing position A, for example.

Because the access cover 11 is disposed near the carriage path S, the filter surface 94*a* can be exposed to the carriage path S if the tenth charged filter 94 is affixed to the inside surface of the access cover 11. Ink mist suspended by the air flow produced in conjunction with movement of the printhead 22 that cannot be completely destaticized by the twelfth static elimination strip 83 can therefore be captured by the tenth charged filter 94. Furthermore, because the tenth charged filter 94 is exposed to the outside of the outside case 9 when the access cover 11 opens, the tenth charged filter 94 can be easily replaced if it is removably installed to the access cover 11.

Embodiment 10

Location of the Static Elimination Member and Charged Member in Embodiment 10

The locations of the static elimination member and charged member in the tenth embodiment are described with reference to FIG. 3 and FIG. 4. Note that parts and content that are the same as in the first to ninth embodiments are identified by like reference numerals and further description thereof is omitted.

As shown in FIG. 3 and FIG. 4, the home position HP (standby position) of the printhead 22 and carriage 27 is between the main conveyance path 13 and the first side frame 45. The away position AP of the printhead 22 and carriage 27 is between the main conveyance path 13 and the second side frame 46. In the tenth embodiment of the invention, a thirteenth static elimination strip 84 is disposed to the carriage 27 path S side of the first side frame 45, and a twelfth charged filter 96 is disposed to the carriage 27 path S side of the second side frame 46.

As described above, the maintenance mechanism 50 of the printhead 22 is located at the home position HP, and a flushing operation, which is a maintenance operation to resolve clogging of the nozzles 36, is performed in the standby mode. By disposing the thirteenth static elimination strip 84 to the first side frame 45 on the home position HP side, the charge can be eliminated from ink mist produced in the flushing operation, and suspension of ink mist can be suppressed. Ink mist that could not be completely destaticized can also be captured by the twelfth charged filter 96 disposed to the second side frame 46.

Embodiment 11

Location of the Static Elimination Member and Charged Member in Embodiment 11

The locations of the static elimination member and charged member in the eleventh embodiment are described with reference to FIG. 3 and FIG. 4. Note that parts and content that are the same as in the first to tenth embodiments are identified by like reference numerals and further description thereof is omitted.

As described above, a printer 1 in this example has a rear frame 55 behind the carriage path S of the carriage 27, and a front frame 56 in front of the carriage path S. The rear frame 55 and front frame 56 extend parallel to each other on the transverse axis X. The front frame 56 is closer to the carriage path S of the printhead 22 in this embodiment. In the eleventh embodiment, a fourteenth static elimination strip 85 is disposed to the front frame 56 on the side facing the carriage path S of the carriage 27, and a thirteenth charged filter 97 is disposed to the rear frame 55 on the side facing the carriage path S of the carriage 27.

Thus comprised, the charge of ink mist produced in conjunction with movement of the printhead 22 and carriage 27 can be eliminated by the fourteenth static elimination strip 85 disposed to the front frame 56 close to the carriage path S of the printhead 22, and suspended ink mist that could not be completely destaticized can be captured by the thirteenth charged filter 97 disposed to the rear frame 55.

INDUSTRIAL APPLICABILITY

The present invention can be used in a fluid ejection device having a fluid ejection head that ejects a fluid as fluid droplets to a medium.

REFERENCE SIGNS LIST

1 printer as a fluid ejection device
9 outside case as a cabinet
11 access cover
13 main conveyance path 13 as a media conveyance path
22 printhead as a fluid ejection head
26 head moving mechanism
27 carriage
27*c* side
27*d* top
29 carriage moving mechanism
36 nozzles
37 nozzle plate
37*a* nozzle face
37*b*-37*e* plate surfaces
45 first side frame
46 second side frame
55 rear frame
56 front frame
60 charged filter as a charged member
61-66 first to sixth charged filters
70 static elimination strip as static elimination member
71-79 first to ninth static elimination strips
81-85 tenth to fourteenth static elimination strip
91-97 seventh to thirteenth charged filters
S carriage movement path (path)
P printing paper as a recording medium
AP away position
HP home position

The invention claimed is:

1. A fluid ejection device comprising:
a fluid ejection head that ejects fluid droplets onto a recording medium;
a carriage that carries the fluid ejection head; and
a static elimination member affixed to the fluid ejection head; and
the static elimination member configured to contactlessly eliminate the electrical charge of an object;
wherein the static elimination member includes a plurality of short conductive fibers,
wherein the fluid ejection head has a nozzle plate in which a nozzle is formed, and
wherein the state elimination member is affixed to the nozzle plate.

2. The fluid ejection device described in claim 1, further comprising:
a carriage moving mechanism that moves the carriage bidirectionally in a scanning direction intersecting the conveyance direction of the recording medium;
the static elimination member being affixed to either or both the side of the carriage or the fluid ejection head facing the direction of travel when the carriage moves toward one end of the path of movement, and the side of the carriage or the fluid ejection head facing the direction of travel when the carriage moves toward the other end of the path of movement.

3. The fluid ejection device described in claim 1, wherein:
the fluid forming the fluid droplets includes ink;
the fluid ejection head includes an inkjet head; and
the fluid ejection device includes an inkjet recording device and a printing device.

4. The fluid ejection device described in claim 1, wherein the static elimination member is a non-woven cloth of fibrous material including the plurality of short conductive fibers.

5. The fluid ejection device described in claim 4, wherein the non-woven cloth is impregnated with a conductive polymer.

6. The fluid ejection device described in claim 1, wherein the plurality of short conductive fibers are woven into a cloth.

7. The fluid ejection device described in claim 1, wherein the plurality of short conductive fibers form a knitted cloth.

8. The fluid ejection device described in claim 1, wherein the static elimination member includes an adhesive layer.

* * * * *